US007161079B2

(12) United States Patent
Nishitani et al.

(10) Patent No.: US 7,161,079 B2
(45) Date of Patent: Jan. 9, 2007

(54) AUDIO SIGNAL GENERATING APPARATUS, AUDIO SIGNAL GENERATING SYSTEM, AUDIO SYSTEM, AUDIO SIGNAL GENERATING METHOD, PROGRAM, AND STORAGE MEDIUM

(75) Inventors: Yoshiki Nishitani, Shizuoka-ken (JP); Akira Miki, Shizuoka-ken (JP); Eiko Kobayashi, Shizuoka-ken (JP); Satoshi Usa, Shizuoka-ken (JP)

(73) Assignee: Yamaha Corporation, Shizuoka-ken (JP)

( * ) Notice: Subject to any disclaimer, the term of this patent is extended or adjusted under 35 U.S.C. 154(b) by 0 days.

(21) Appl. No.: 10/143,086

(22) Filed: May 9, 2002

(65) Prior Publication Data

US 2002/0166439 A1 Nov. 14, 2002

(30) Foreign Application Priority Data

May 11, 2001 (JP) ..... 2001-142281

(51) Int. Cl.
*G10H 7/00* (2006.01)

(52) U.S. Cl. ..... 84/612; 84/636; 84/615

(58) Field of Classification Search ..... 84/600–609, 84/612, 636, 615, 652, 653, 668
See application file for complete search history.

(56) References Cited

U.S. PATENT DOCUMENTS 5,027,688 A 7/1991 Suzuki
5,046,394 A 9/1991 Suzuki
5,058,480 A 10/1991 Suzuki
5,177,311 A 1/1993 Suzuki
5,290,964 A 3/1994 Hiyoshi
5,313,010 A 5/1994 Matsushima
5,512,703 A 4/1996 Usa
5,585,584 A 12/1996 Usa
5,648,627 A * 7/1997 Usa ..... 84/600
5,663,514 A 9/1997 Usa
6,169,240 B1 * 1/2001 Suzuki ..... 84/605
2001/0015123 A1 8/2001 Nishitani

FOREIGN PATENT DOCUMENTS

JP 06-178396 6/1994
JP 09-127937 5/1997
JP 09-281963 10/1997
JP 2000-156049 6/2000
JP 2001-083969 3/2001

* cited by examiner

*Primary Examiner*—Lincoln Donovan
*Assistant Examiner*—David S. Warren
(74) *Attorney, Agent, or Firm*—Harness, Dickey & Pierce, P.L.C.

(57) ABSTRACT

An audio signal generating apparatus is provided which makes it possible to supply a new music entertainment that enables users to actively participate in performance of musical compositions based on audio data that is coded in a predetermined format from audio signals, and a program for implementing the method, and a storage medium storing the program. Motion information corresponding to a motion of a user is acquired. An audio signal is acquired from audio data coded from the audio signal according to the predetermined format, and processing is performed on the acquired audio signal according to acquired motion information.

15 Claims, 17 Drawing Sheets

*FIG. 6*

| AUDIO DATA STORAGE AREA | TEMPO ADJUSTMENT DATA STORAGE AREA |
|---|---|
| FRAME 1 | TEMPO MARK |
| FRAME 2 | ⋮ |
| FRAME 3 | |
| ⋮ | |
| FRAME n | TEMPO MARK |
| ⋮ | ⋮ |
| FRAME 2n | TEMPO MARK |
| ⋮ | ⋮ |

AUDIO SIGNAL GENERATING APPARATUS, AUDIO SIGNAL GENERATING SYSTEM, AUDIO SYSTEM, AUDIO SIGNAL GENERATING METHOD, PROGRAM, AND STORAGE MEDIUM

BACKGROUND OF THE INVENTION

1. Field of the Invention

The present invention relates to an audio signal generating apparatus, an audio signal generating system, an audio system, and an audio signal generating method, which generate an audio signal according to motion of a user, and a program for implementing the method, and a storage medium storing the program.

2. Description of the Related Art

Musical tone generating apparatuses such as audio equipment are capable of sounding desired musical tones once four performance parameters such as the tone color, pitch, volume, and effect have been determined. In recent years, a variety of audio reproducing apparatuses such as CD (Compact Disc) players, MD (Mini Disc) players, MP3 (Moving Picture Experts Group Player-1 Audio Layer 3) players have been in widespread use. To enjoy listening to music, users set recording media (e.g. CD and MD), on which audio data are recorded in formats reproducible by respective audio reproducing apparatuses, in the audio reproducing apparatuses so that the audio data can be reproduced. The users can control parameters such as the volume when reproducing musical compositions based on the audio data by such audio reproducing apparatuses, by operating operating knobs, buttons, or the like thereof.

When making performance by the above-mentioned audio reproducing apparatuses, the users operate operating elements such as operating knobs in order to achieve a desired volume and desired other performance parameters. To control performance parameters by operating operating knobs is effective for the users to listen to musical compositions reproduced by the audio reproducing apparatuses with a desired volume or the like. The conventional audio reproducing apparatuses, however, cannot provide the users with the pleasure of actively participating in performance of musical compositions although they are capable of reproducing musical compositions recorded on commercially available CDs and the like with fidelity. By enabling the users to actively participate in performance of musical compositions, the audio reproducing apparatuses would provide a new way of enjoying music. Although it goes without saying that musical compositions may be performed using a variety of conventional musical instruments and electronic musical instruments, it is possible to provide a new music entertainment if musical tones reflecting motions such as gestures of the users are generated by a different method from the conventional musical instruments.

SUMMARY OF THE INVENTION

It is therefore an object of the present invention to provide an audio signal generating apparatus, an audio signal generating system, an audio system, and an audio signal generating method, which make it possible to supply a new music entertainment that enables users to actively participate in performance of musical compositions based on audio data that is coded in a predetermined format from audio signals, and a program for implementing the method, and a storage medium storing the program.

To attain the above object, in a first aspect of the present invention, there is provided an audio signal generating apparatus comprising a motion information acquiring device that acquires motion information corresponding to a motion of a user, an audio signal acquiring device that acquires an audio signal from audio data coded from the audio signal according to a predetermined format, and a signal processing device that performs processing on the audio signal acquired by the audio signal acquiring device according to the motion information acquired by the motion information acquiring device.

According to the first aspect of the present invention, an audio signal is acquired from audio data coded from the audio signal according to a predetermined format, e.g. audio data recorded on a commercially available music CD, and signal processing is performed on the audio signal according to, i.e. in a manner reflecting a motion of the user, to thereby carry out reproduction of a musical composition or the like. Therefore, it is possible to provide a music entertainment that enables users to positively participate in performing musical compositions by using audio data that is coded from an audio signal according to a predetermined format.

Preferably, the audio signal generating apparatus according to the first aspect further comprises a recording device that records the audio signal having been processed by the signal processing device according to the motion information.

In a typical preferred form of the first aspect, the motion information acquiring device receives motion information transmitted from at least one operating terminal capable of being carried by an operator, the operating terminal generating the motion information corresponding to a motion of the operator carrying the operating terminal, and the signal processing device performs processing on the audio signal acquired by the audio signal acquiring device according to the motion information received by the motion information acquiring device.

In a specific preferred form of the first aspect, the signal processing device performs processing for controlling at least one selected from the group consisting of tempo, volume, timing, tone color, and effect on the audio signal acquired by the audio signal acquiring device according to the motion information.

In a further specific preferred form of the first aspect, the signal processing device performs time-base compression and expansion of the audio signal acquired by the audio signal acquiring device so as to convert the audio signal into an audio signal with a tempo corresponding to the motion information.

In a still further specific preferred form of the first aspect, the signal processing device performs tone image localization of the audio signal acquired by the audio signal acquiring device.

In a further specific preferred form of the first aspect, the signal processing device carries out amplitude adjustment of the audio signal acquired by the audio signal acquiring device in every predetermined frequency band.

In a further specific preferred form of the first aspect, the audio signal generating apparatus further comprises a determination device that determines an offset amount from an original tempo of the audio signal acquired by the audio signal acquiring device according to the motion information, and wherein the signal processing device changes the original tempo of the acquired audio signal by the determined offset amount.

In a further specific preferred form of the first aspect, the motion information acquiring device comprises a plurality of motion information acquiring devices, and the signal processing device performs processing for controlling different objects according to the motion information acquired by respective ones of the motion information acquiring devices, on the audio signal acquired by the audio signal acquiring device.

To attain the above object, the first aspect of the present invention also provides an audio signal generating system comprising at least one operating terminal capable of being carried by an operator, the operating terminal generating motion information corresponding to a motion of the operator carrying the operating terminal and transmitting the generated motion information, and an audio signal generating device that generates an audio signal from audio data coded from the audio signal according to a predetermined format, and wherein the audio signal generating device comprises a receiving device that receives the motion information transmitted from the operating terminal, an audio signal acquiring device that acquires an audio signal from the audio data, and a signal processing device that performs processing on the audio signal acquired by the audio signal acquiring device according to the motion information acquired by the receiving device.

To attain the above object, the first aspect of the present invention further provides an audio signal generating method comprising the steps of acquiring motion information corresponding to a motion of a user, acquiring an audio signal from audio data coded from the audio signal according to a predetermined format, and performing processing on the acquired audio signal according to the acquired motion information.

To attain the above object, the first aspect of the present invention still further provides a program that causes a computer to execute the above audio signal generating method, and a machine readable storage medium containing a group of instructions for causing a machine to execute the above audio signal generating method.

To attain the above object, in a second aspect of the present invention, there is provided an audio system comprising at least one operating terminal capable of being carried by an operator, the operating terminal generating motion information corresponding to a motion of the operator carrying the operating terminal and transmitting the generated motion information, a receiving device that receives the motion information transmitted from the operating terminal, a reproducing device that reproduces an audio signal from audio data coded from the audio signal according to a predetermined format, a musical contents acquiring device that acquires first musical contents information including at least one of a pitch sequence and beats constituting a musical composition in the audio data being reproduced by the reproducing device, a musical contents information producing device that produces second musical contents information including at least one of pitch information and beat information according to the motion information received by the receiving device when the audio data is being reproduced by said reproducing device, and a determination device that compares the first musical contents information and the second musical contents information and outputs results of the comparison.

According to the second aspect of the present invention, while a musical composition is reproduced based on an audio signal acquired from audio data coded from the audio signal according to a predetermined format, e.g. audio data recorded on a commercially available music CD, musical contents produced according to a motion of a user and actual musical contents being reproduced are compared with each other, and results of the comparison are outputted. This provides a new music entertainment that integrates performance of a musical composition reproduced from a music CD or the like with a motion of the user.

The above and other objects, features, and advantages of the invention will become more apparent from the following detailed description taken in conjunction with the accompanying drawings.

BRIEF DESCRIPTION OF THE DRAWINGS

FIGS. 5A and 5B are diagrams useful in explaining processing that is performed by a motion analysis section in FIG. 4, wherein:

FIG. 5A shows an example of the transition of an absolute value of acceleration; and FIG. 5B shows an example of a detection result signal that is generated based on the transition of the absolute value of the acceleration in FIG. 5A;

FIG. 6 is a diagram useful in explaining a storage area that stores data required for signal processing by an audio signal processing section;

FIGS. 7A–7C are diagrams useful in explaining the signal processing performed by the audio signal processing section in FIG. 4, wherein:

FIG. 7A shows an example of an audio signal that is reproduced by decoding audio data recorded on a certain CD by a CD reproducing section in FIG. 4;

FIG. 7B shows an example of motion timing information provided by operating the operating terminal in FIG. 1 by an operator; and FIG. 7C shows an example of an audio signal with a tempo controlled according to the operation of an operator;

FIGS. 10A and 10B are diagrams useful in explaining the relationship between an output signal from a gradient sensor incorporated in the operating terminal of the musical tone generating system, and processing performed on an audio signal, wherein:

FIG. 10A shows an example of the output signal from the gradient sensor; and FIG. 10B shows an example of processing that is performed on the audio signal according to the output signal in FIG. 10A;

FIGS. 13A and 13B are diagrams useful in explaining the relationship between the condition of the operating terminal shown in FIG. 11 and signal processing performed according to the condition of the operating terminal, wherein:

FIG. 13A shows an example of the condition of the operating terminal that is operated by an operator; and FIG. 13B shows an example of the signal processing performed according to the state shown in FIG. 13A;

DETAILED DESCRIPTION OF THE PREFERRED EMBODIMENT

The present invention will now be described in detail with reference to the drawings showing a preferred embodiment thereof.

Figure 1:
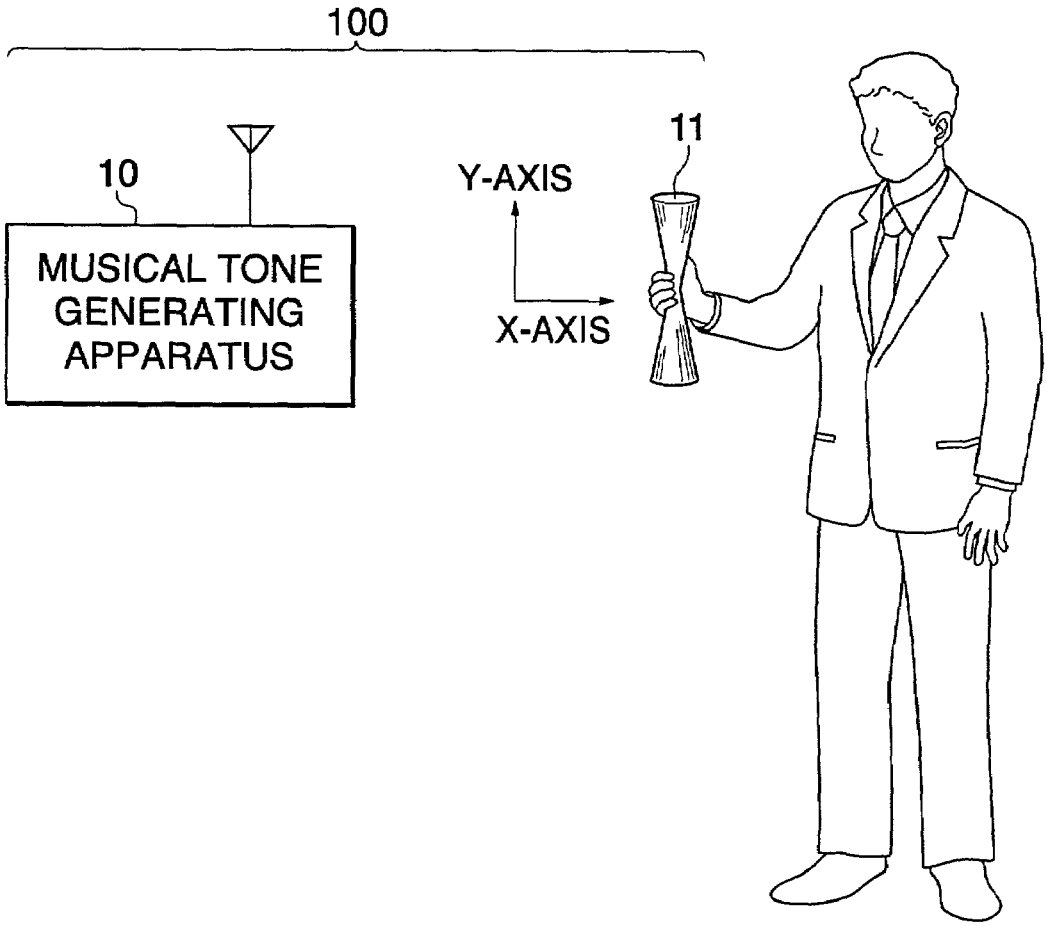
FIG. 1 is a schematic diagram showing a musical tone generating system according to an embodiment of the present invention.

FIG. 1 shows a musical tone generating system (audio signal generating system) according to an embodiment of the present invention. As shown in FIG. 1, the musical tone generating system 100 is comprised of a musical tone generating apparatus (audio signal generating apparatus) 10, and an operating terminal 11 capable of being carried by an operator.

The operating terminal 11 according to the present embodiment is rod-shaped such that the diameter decreases away from both ends toward the central part thereof. As shown in FIG. 1, the operator operates the operating terminal 11 while holding the central part thereof with a smaller diameter. The musical tone generating system 100 generates musical tones according to a motion of the operating terminal 11 held by the operator, that is, a motion of the hand of the operator. It should be noted that the operating terminal 11 should not necessarily be designed to be held by the hand of the operator, but also may be designed to be worn on an arm or leg via a band or the like. The operating terminal 11 may be arbitrarily shaped, and may be attached to the operator in an arbitrary manner.

Figure 2:
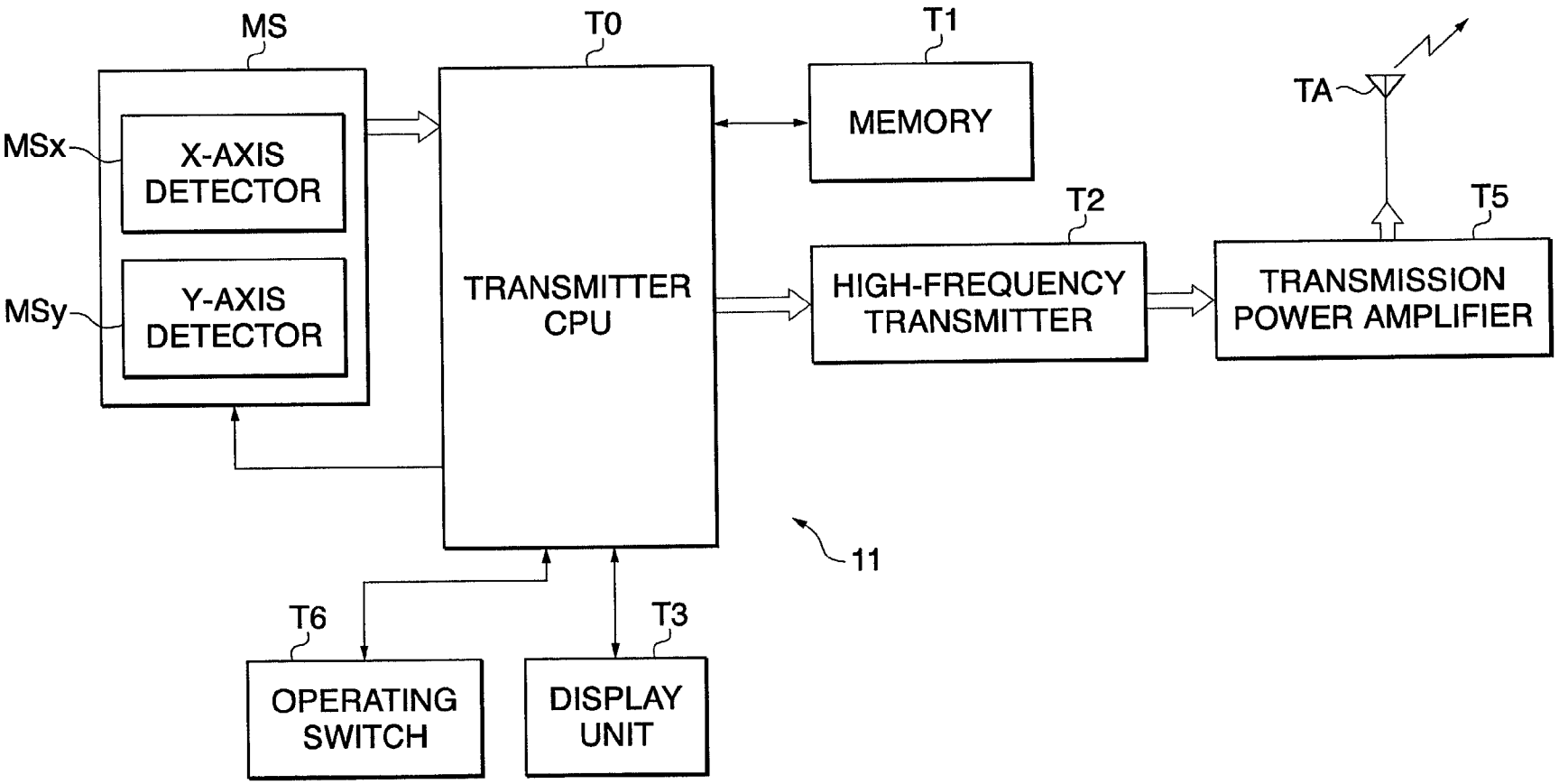
FIG. 2 is a block diagram showing the hardware construction of an operating terminal as a component part of the musical tone generating system in FIG. 1.

FIG. 2 is a block diagram showing the construction of the operating terminal 11. As shown in FIG. 2, the operating terminal 11 is comprised of a motion sensor MS, a transmitter CPU TO, a memory T1, a high-frequency transmitter T2, a display unit T3, a transmission power amplifier T5, an operating switch T6, and a transmission antenna TA.

When the operating terminal 11 is used, that is, when the musical tone generating system 100 (refer to FIG. 1) generates musical tones, the motion sensor MS detects a motion of the operator carrying the operating terminal 11 (e.g. a motion of the hand holding the operating terminal 11 in a case where the operating terminal is held by the hand as shown in FIG. 1) to generate motion information. A variety of sensors such as a three-dimensional acceleration sensor, a three-dimensional velocity sensor, a two-dimensional acceleration sensor, a two-dimensional velocity sensor, a gradient sensor, a strain sensor, and an impact sensor may be used as the motion sensor MS. In the present embodiment, the two-dimensional acceleration sensor is used as the motion sensor MS. As shown in FIG. 2, the motion sensor MS is comprised of an x-axis detector MSx and a y-axis detector MSy. The x-axis detector MSx and the y-axis detector MSy detect the acceleration in the direction of the x-axis (horizontal direction) and in the direction of the y-axis (vertical direction), as shown in FIG. 1, respectively.

The transmitter CPU TO controls the operations of the motion sensor MS, the high-frequency transmitter T2, and the display unit T3 according to a transmitter operation program that is stored in the memory T1. The transmitter CPU TO performs predetermined processing such as assignment of ID numbers to detection result signals (detected motion signals) outputted from the motion sensor MS, and transmits the same to the high-frequency transmitter T2. The detected motion signals are then amplified by the transmission power amplifier T5, and are radio-transmitted to the musical tone generating apparatus 10 via the transmission antenna TA.

The display unit T3 is comprised of, for example, a 7-segment type LED (Light Emitting Diode) or LCD (Liquid Crystal Display) display unit, and one or more LED lights. The display unit T3 displays a variety of information indicative of the sensor number, operation on/off state, and power alarm, and so forth. The operating switch T6 is used for turning the power of the motion detecting terminal 5 on and off, setting the mode, and other settings. These component parts of the operating terminal 11 are supplied with drive power from a battery power unit, not shown. As this battery power unit, it is possible to use a primary cell or to use a rechargeable secondary cell.

Figure 3:
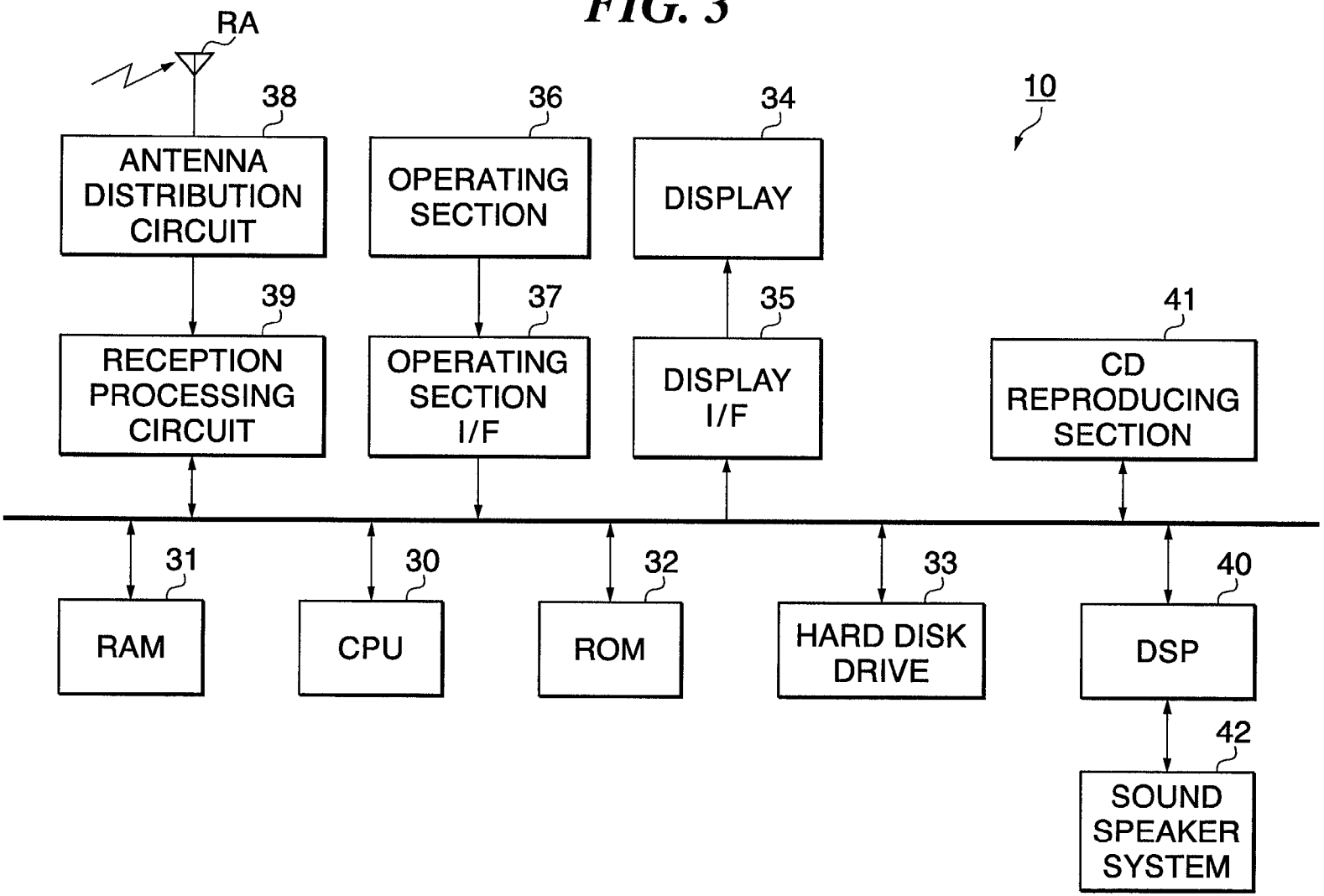
FIG. 3 is a block diagram showing the hardware construction of a musical tone generating apparatus as a component part of the musical tone generating system in FIG. 1.

A description will now be given of the construction of the musical tone generating apparatus 10 with reference to FIG. 3. As shown in FIG. 3, the musical tone generating apparatus 10 is comprised of a CPU (Central Processing Unit) 30, a RAM (Random Access Memory) 31, a ROM (Read Only Memory) 32, a hard disk drive 33, a display 34, a display interface 35, an operating section 36, an operating section interface 37, an antenna RA, an antenna distribution circuit 38, a reception processing circuit 39, a CD reproducing section (audio signal acquiring means) 41, a DSP (Digital Signal Processor) 40, and a sound speaker system 42.

The CPU 30 performs various operations and controls the operations of component parts of the musical tone generating apparatus 10. The RAM 31 serves as a work memory for the operation of the CPU 30. The ROM 32 stores a group of programs that are read out and executed by the CPU 30. The hard disk drive 33 stores a group of various control programs that are read out and executed by the CPU 30 and a group of data, and also stores audio data and others. The display 34 is a CRT (Cathode Ray Tube), an LCD, or the like, and displays images viewed by the operator. The display interface 35 causes the display 34 to display images according to data supplied from the CPU 30. The operating section 36 is a keyboard, a mouse, and the like operated by the operator to input his or her instructions. The operating section interface 37 supplies the CPU 30 with data representing the instructions inputted via the operating section 36. The antenna distribution circuit 38 receives radio signals transmitted from the operating terminal 11 (refer to FIGS. 1 and 2) via the antenna RA. The reception processing circuit 39 captures the radio signals received by the antenna distribution circuit 38 and converts the same into data that can be processed by the CPU 30.

The CD reproducing section 41 is actuated upon setting of a CD on which digital-coded audio data is recorded in a format conforming to the CD-DA (Compact Disk-Digital Audio) standards (hereinafter referred to as "music CD"), to read out and reproduce the audio data recorded on the music CD to output a digital audio signal. The DSP 40 performs signal processing such as time-base compression and expansion of the digital audio signal reproduced by the CD reproducing section 41, and outputs the resulting audio signal to the sound speaker system 42. The sound speaker system 42 converts the signal-processed audio signal supplied from the DSP 40 into an analog signal, and generates musical tones corresponding to the analog signal via a speaker.

Figure 4:
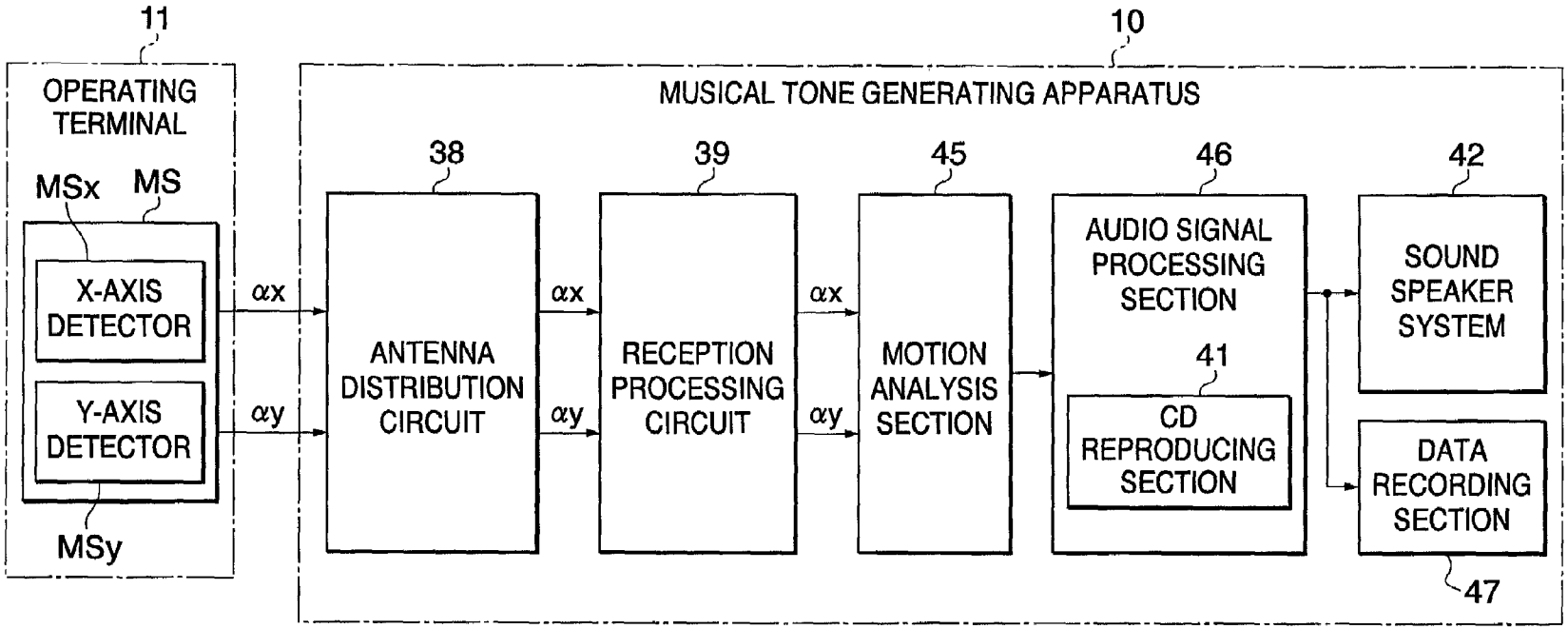
FIG. 4 is a block diagram showing the functional arrangement of the musical tone generating system in FIG. 1.

The musical tone generating apparatus 10 is constructed such that the CPU 30 carries out a later-described motion analyzing process and the like by executing a group of musical tone generating process-executing programs stored in the ROM 32 and the hard disk drive 33 in response to turning-on of a power supply, not shown, and instructions inputted by the operator via the operating section 36, and controls the overall operation of the musical tone generating apparatus 10 so as to carry out musical tone generating processing corresponding to the motion information transmitted from the operating terminal 11. Referring to FIG. 4, a description will now be given of the functional arrangement of the musical tone generating apparatus 10 that carries out such musical tone generating processing.

As shown in FIG. 4, the musical tone generating apparatus 10 is comprised of the antenna distribution circuit 38, the reception processing circuit 39, a motion analysis section 45, an audio signal processing section 46, the sound speaker system 42, and a data recording section 47.

The antenna distribution circuit 38 receives detected motion signals transmitted from the x-axis detector MSx and the y-axis detector MSy of the operating terminal 11 operated by the operator, that is, the acceleration $\alpha x$ in the direction of the x-axis and the acceleration $\alpha y$ in the direction of the y-axis, and then outputs the detected motion signals to the reception processing circuit 39.

The reception processing circuit 39 subjects the detected motion signals indicative of the acceleration in the direction of the x-axis and the acceleration in the direction of the y-axis, supplied from the antenna distribution circuit 38, to predetermined band pass filtering to remove frequencies that are unnecessary for the motion analysis section 35 to detect the motion of the operating terminal 11. The reception processing circuit 39 also removes an acceleration component corresponding to the gravity of the earth. The reception processing circuit 39 then outputs signals indicative of the acceleration ax and the acceleration $\alpha y$, from which the unnecessary frequencies have been removed, to the motion analysis section 45.

The motion analysis section 45 detects the motion of the operating terminal 11 operated by the operator from the acceleration $\alpha x$ in the direction of the x-axis and the acceleration $\alpha y$ in the direction of the y-axis supplied from the reception processing circuit 39, and outputs the detection result to the audio signal processing section 46. Specifically, the motion analysis section 45 analyzes data on the acceleration in the direction of each axis to find an absolute value $|\alpha|$ of the acceleration, which is represented by the following expression (1):

$$|\alpha|=(\alpha x x \alpha x+\alpha y x \alpha y)^{1/2} \quad (1)$$

Figure 5A:
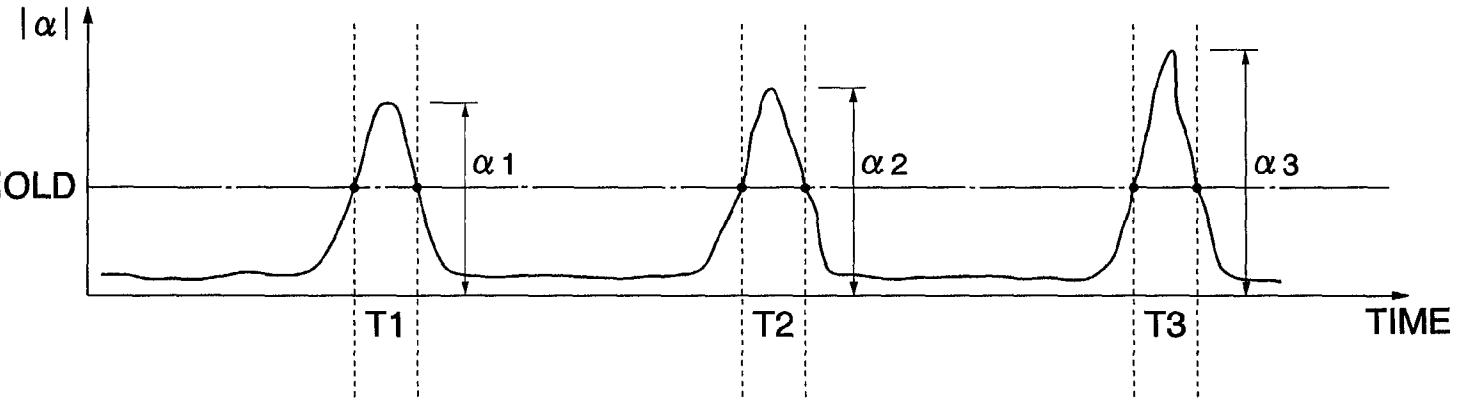
Figure 5B:
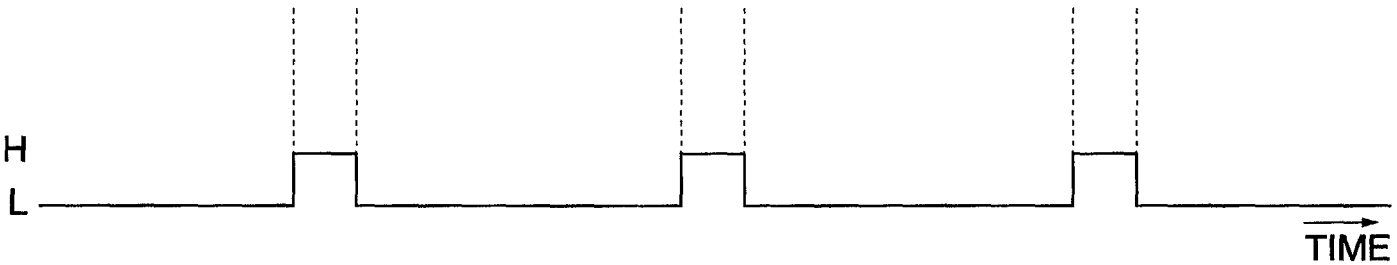

The motion analysis section 45 determines whether the absolute value $|\alpha|$ of the acceleration thus found is greater than a predetermined threshold or not. According to the determination result, the motion analysis section 45 outputs a signal indicative of motion timing in which the operator widely moves the operating terminal 11 to the audio signal processing section 46. Specifically, if the absolute value $|\alpha|$ is greater than the threshold, the motion analysis section 45 outputs a high level signal to the audio signal processing section, and if the absolute value $|\alpha|$ is not greater than the threshold, the motion analysis section 45 outputs a low level signal to the audio signal processing section 46. For example, if the operator widely moves the operating terminal 11 in timing T1, T2, T3 . . . , the absolute value $|\alpha|$ of the acceleration found by the motion analysis section 45 is increased in the timing T1, T2, T3 . . . as shown in FIG. 5A, and hence a detection result signal as shown in FIG. 5B is acquired and outputted as motion timing information to the audio signal processing section 46. The motion analysis section 45 also outputs moving amount information such as absolute values $\alpha 1$, $\alpha 1$, $\alpha 3$ . . . of the acceleration in excess of the threshold to the audio signal processing section 46.

The audio signal processing section 46 performs signal processing on the digital audio signal, which has been read from the music CD to be reproduced by the CD reproducing section 41, according to the motion timing information and the moving amount information supplied from the motion analysis section 45, and outputs the resulting signal to the sound speaker system 42 and the data recording section 47. A detailed description will now be given of the signal processing that is performed by the audio signal processing section 46 in accordance with the motion timing information and the moving amount information.

To carry out the musical tone generating process, the audio signal processing section 46 stores, in a storage area prepared in advance (e.g. the hard disk drive 33 or the RAM 31), audio data (e.g. audio data of one musical composition) recorded on the music CD, and tempo control data with tempo mark information embedded therein at regular time intervals (n frames in the illustrated example) as shown in FIG. 6 in a period of time in which the audio data are to be reproduced. The time intervals at which the tempo mark information is embedded may be arbitrarily set by the operator for every musical composition when the operator makes performance of the musical composition, or may be set to a fixed value in advance. The audio signal processing section 46 reads out the audio data and the tempo control data at a readout speed at which an ordinary music CD is reproduced, and the CD reproducing section 41 decodes the readout audio data to generate a digital audio signal, as is the case with conventional CD players. In this way, in the audio signal processing section 46, the CD reproducing section 41 decodes the audio data recorded on the music CD to reproduce the audio signal, and carries out the time-base compression and expansion of the audio signal reproduced by the CD reproducing section 41 according to the timing in which the tempo mark information appears when tempo control data is read out and the timing in which the high level signal appears in the motion timing information (refer to FIG. 5B), namely, the timing in which the operator widely moves the operating terminal 11. This enables control of the tempo while hardly changing the pitch of the musical composition sounded via the sound speaker system 41.

Figures 7A, 7B, 7C:
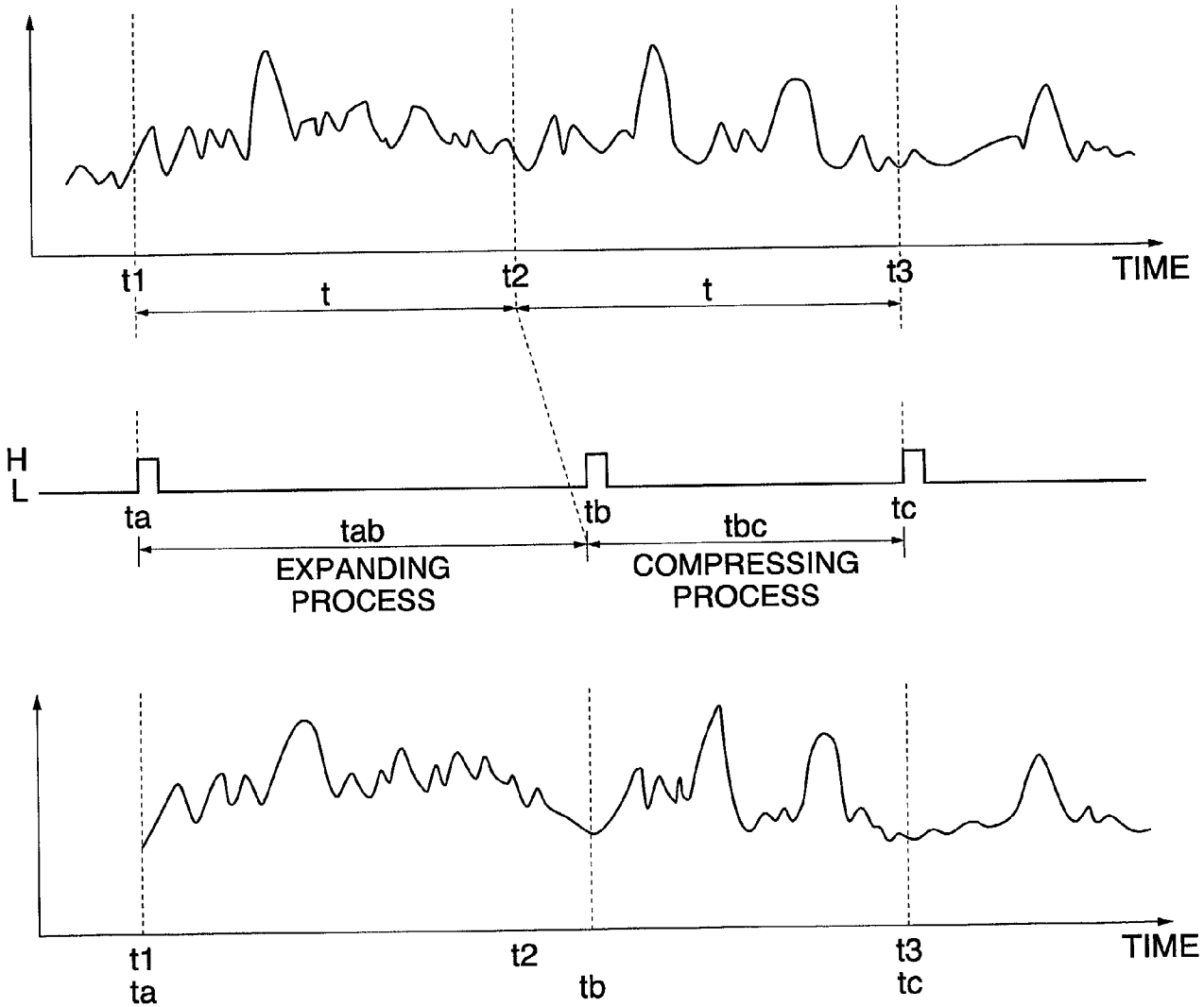

The time-base compression and expansion carried out by the audio signal processing section 46 will now be described by way of an example in which a music CD is normally reproduced to output an audio signal (represented by an analog waveform for convenience of explanation) as shown in FIG. 7A in a certain interval, and the operator operates the operating terminal 11 to supply motion timing information indicative of timing "ta", "tb", "tc" in which the signal becomes high level as shown in FIG. 7B in a case where tempo mark is given to timing "t1", "t2", "t3" (the timer interval "t" between "t1", "t2", and "t3" is constant) in FIG. 7A.

In this example, the timing "ta" indicated by the motion timing information coincides with the timing "t1" indicated by the tempo mark information, the timing "tb" is later than the timing "t2", and the timing "tc" coincides with the timing "t3". Specifically, an interval "tab" between the timing "ta" and the timing "tb" in which the operator widely moves the operating terminal 11 is longer than the constant interval "t" indicated by the tempo mark information, and an interval "tbc" between the timing "tb" and the timing "tc" is shorter than the constant interval "t". If the interval (i.e. the interval "tab") between the timing in which the operator widely moves the operating terminal 11 and the timing in which the operator widely moves the operating terminal 11 next is longer than the constant interval "t", the audio signal processing section 46 carries out the time-base expansion of the audio signal in a corresponding interval (t1 to t2). This time-base expansion is carried out at an expansion ratio of tab/t.

On the other hand, if the interval between the timing in which the operator widely moves the operating terminal 11 and the timing in which the operator widely moves the operating terminal 11 next (interval "tbc") is shorter than the constant interval "t", the time-base compression of the audio signal is carried out in a corresponding interval (t2 to t3). This time-base compression is carried out at a compression ratio of tbc/t. In this way, the audio signal processing section 46 carries out the time-base compression and expansion according to the timing in which the operator widely moves the operating terminal 11 to generate the audio signal with its tempo controlled according to the motion of the operator as shown in FIG. 7C. The audio signal processing section 46 may carry out the time-base compression and expansion by a variety of known methods such as the cut-and-splice method; the overlap-add method based on pointer shift amount control; and the repetition of reverberation, dither, and loop.

In this way, the audio signal processing section 46 carries out the time-base compression and expansion of the audio signal according to the motion timing information supplied from the motion analysis section 45, i.e. the information indicative of the timing in which the operator widely moves the operating terminal 11, thus controlling the tempo without greatly changing the pitch of musical tones being generated.

Further, the audio signal processing section 46 carries out the time-base compression and expansion according to the motion of the operator as described above, and controls the volume of the musical tones according to the moving amount information supplied from the motion analysis section 45. Specifically, assuming that the moving amount indicating the magnitude of motion in the timing "ta", "tb", "tc" in which the operator widely moves the operating terminal 11 is "αa", "αb", "αc", the audio signal in the interval "tab" is amplified at an amplification factor corresponding to the moving amount "αa", the audio signal in the interval "tbc" is amplified at an amplificationfactor corresponding to the moving amount "αb", and the audio signal in the interval from the timing "tc" to the next motion timing is amplified at an amplification factor corresponding to the moving amount "αc". The larger the value represented by the moving amount information, the larger the amplification factor, thus making it possible to control the volume of musical tones being generated according to the degree of motion of the operator who widely moves the operating terminal 11.

As described above, the audio signal processing section 46 performs signal processing on the audio signal, which is acquired by the CD reproducing section 41 by reproduction of the music CD, according to the motion timing information and the moving amount information supplied from the motion analysis section 45. The audio signal processing section 46 then outputs the resulting audio signal to the sound speaker system 42 and the data recording section 47. The sound speaker system 42 converts the audio signal, which has thus been processed according to the motion of the operator and supplied from the audio signal processing section 46, into the analog signal and amplifies the same and sounds the amplified analog signal via the speaker, thus reproducing the musical composition controlled according to the motion of the operator. The data recording section 47 records the audio signal, which is supplied from the audio signal processing section 46, on a predetermined recording medium, such as a CD-R (CD-Recordable), an MD, a semiconductor memory, or a hard disk drive.

A description will now be given of a method of generating musical tones by the operator using the musical tone generating system 100 constructed as described above. First, the operator applies power to the musical tone generating apparatus 10 and the operating terminal 11 constituting the musical tone generating system 100 to cause the musical tone generating apparatus 10 to execute the group of the musical tone generating process-executing programs for generation of musical tones. The operator sets a music CD, on which a musical composition desired for performance is recorded, in the CD reproducing section 41, and then gives an instruction for starting performance of the musical composition. Incidentally, to specify time intervals at which the above-mentioned tempo mark information (refer to FIG. 6) is embedded, the operator inputs information indicative of time intervals such as three seconds by operating the operating section 36, whereby production of tempo control data with the tempo mark information embedded therein is carried out according to the time interval information inputted via the musical tone generating apparatus 10.

After setting the music CD and giving the instruction for starting the performance as mentioned above, the operator 11 widely swings the hand holding the operating terminal 11 to control the tempo and volume of the musical composition that is reproduced by reading audio data recorded on the music CD. As described above, the musical tone generating apparatus 10 reproduces the musical composition recorded on the music CD at a tempo corresponding to the timing in which the operator widely moves the operating terminal 11. For example, if the operator widely moves the operating terminal 11 at shorter time intervals than the time interval (e.g. three seconds) inputted by him or her, the musical composition is reproduced at a faster tempo than in normal reproduction of a music CD. On the other hand, if the operator widely moves the operating terminal 11 at longer time intervals than the time interval inputted by him or her, the musical composition is reproduced at a slower tempo than in normal reproduction of a music CD. Further, if the operator widely moves the operating terminal 11 in a certain interval at shorter time intervals than the time interval inputted by him or her and widely moves the operating terminal 11 in some other interval at longer time intervals than the time interval inputted by him or her, the musical composition is reproduced at a fast tempo in the certain section and at a slow tempo in the other section.

As described hereinabove, according to the present embodiment, the volume and tempo of reproduction can be controlled according to a motion of the operator when a tone generating source such as a commercially available music CD is reproduced. Therefore, although in the prior art, a user cannot do anything but control an operating element such as an operating dial during reproduction of a music CD in order to achieve a desired volume and the like, the musical tone generating system 100 according to the present embodiment not only reproduces musical compositions with high fidelity but also enables the user to positively participate in reproduction of musical compositions. Therefore, the musical tone generating system 100 according to the present embodiment provides a new way of enjoying music. Further, since commercially available CDs are used as tone generating sources, the musical tone generating system 100 according to the present embodiment provides a new way of enjoying reproduction of musical tones as described above when many commercially available musical compositions are reproduced. Further, since the data recording section 47 is capable of recording an audio signal of musical tones having been controlled according to a motion of the operator as described above, the musical tone generating system 100 according to the present embodiment is capable of reproducing the recorded audio signal later to reproduce the original musical composition controlled according to the motion of the operator.

Further, as described below, the musical tone generating method using the tone generating system 100 according to the present embodiment provides a new music entertainment by using commercially available music CDs without requiring preparation of special musical composition data or the like. First, although conventional musical instruments, electronic musical instruments, and the like generate desired musical tones by selectively operating performance operating elements (such as the keyboard of a piano and the strings of a guitar), the musical tone generating system 100 according to the present embodiment is able to control generation of musical tones from a music CD by simple operation of moving the operating terminal 11 by the operator without requiring such selective operation of operating elements. Specifically, the conventional musical instruments and the like pursue an operability that enables excellent performance by selective operation of operating elements by fingers, whereas the musical tone generating system 100 according to the present embodiment does not place emphasis on such operability. The musical tone generating system 100 according to the present embodiment makes musical tones being generated correspond to relatively wide motions of the operating terminal 11 carried by the operator, thus providing a new music entertainment system that enables generation of musical tones according to motions of the human body.

It should be understood that there is no intention to limit the present invention to the embodiment disclosed, but the present invention may cover all variations as described hereinbelow.

Variation 1

In the above described embodiment, the audio signal is amplified according to the absolute value of the acceleration detected by the motion sensor MS, which represents the magnitude of motion of the operating terminal 11 when the operator widely moves the operating terminal 11 to some degree, thereby controlling the volume of musical tones being generated. It should be understood, however, that there is no intention to limit the invention to this, but the audio signal reproduced by the CD reproducing section 41 may be amplified according to the frequency and variation of a signal acquired from the motion sensor MS to thereby control the volume of musical tones being generated. For example, if a signal outputted from the motion sensor MS has a high frequency, i.e. if the operator moves the operating terminal 11 at short intervals, the volume is controlled to increase, and if the operator moves the operating terminal 11 at long intervals, the volume is controlled to decrease. In this case, insofar as the operator knows what motion causes an increase or decrease in the volume, he or she only has to move the operating terminal 11 according to a desired volume. Therefore, the operator can positively participate in reproduction of a musical composition, as is the case with the above described embodiment.

Variation 2

Further, although in the above described embodiment, the tempo of a musical composition being reproduced is controlled by carrying out the time-base compression and expansion of an audio signal reproduced by the CD reproducing section 41 at constant time intervals "t" according to the timing in which the operator widely moves the operating terminal 11, the tempo of a musical composition may be controlled by another method as described below.

The tempo of a musical composition being reproduced may be controlled by finding an offset amount from a predetermined default tempo at which a musical composition is reproduced by the CD reproducing section 41 with reference to a motion of the operator, and making the tempo faster or slower than the default tempo according to the offset amount by the CD reproducing section 41. Specifically, a tempo controlling function installed in ordinary CD players is used to determine an offset amount from a default tempo control amount provided for the function, according to a motion of the operating terminal 11 carried by the operator, so that the tempo can be controlled according to the motion of the operator.

In controlling the tempo in the above-mentioned manner, the offset amount may be determined in the following manner: An offset amount is obtained, which causes the tempo to be increased in an interval where a signal outputted from the motion sensor MS has a higher frequency than a predetermined reference frequency (e.g. the operator moves the operating terminal 11 at short intervals), and an offset amount is obtained which causes the tempo to be decreased in an interval where a signal outputted from the motion sensor MS has a lower frequency than the predetermined reference frequency (e.g. the operator moves the operating terminal 11 at long intervals).

Further, in a case where a gradient sensor is used as the motion sensor MS, if an output from the gradient sensor indicates a positive gradient, an offset amount is obtained which causes the tempo to be increased, and if the output from the gradient sensor indicates a negative gradient, an offset amount is obtained which causes the tempo to be decreased. In this case, insofar as the operator knows what motion causes an increase or decrease in the tempo, he or she only has to move the operating terminal 11 according to a desired tempo. Therefore, the operator can positively participate in reproduction of a musical composition as is the case with the above described embodiment.

Variation 3

Further, although in the above described embodiment, it is assumed that a single operating terminal 11 is provided, this is not limitative, but two or more operating terminals 11 may be provided. If two or more operating terminals 11 are provided, each of the operating terminals 11 transmits ID information for identifying the terminal as well as an output from the motion sensor MS to the musical tone generating apparatus 10. This enables the musical tone generating system 10 to detect what motion is indicated by the information supplied from which one of the operating terminals 11. The musical tone generating apparatus 10 then performs processing on an audio signal reproduced by the CD reproducing section 41 according to outputs from the motion sensors MS, which are supplied from the two or more operating terminals 11, thus controlling the volume or the tempo. If two or more operating terminals 11 are provided, objects of control (e.g. tempo, volume, tone color, and effect) may be assigned to respective ones of the operating terminals 11 so that the tempo can be controlled according to a motion of a certain operating terminal 11 and the volume can be controlled according to a motion of another operating terminal 11, for example.

Figure 8:
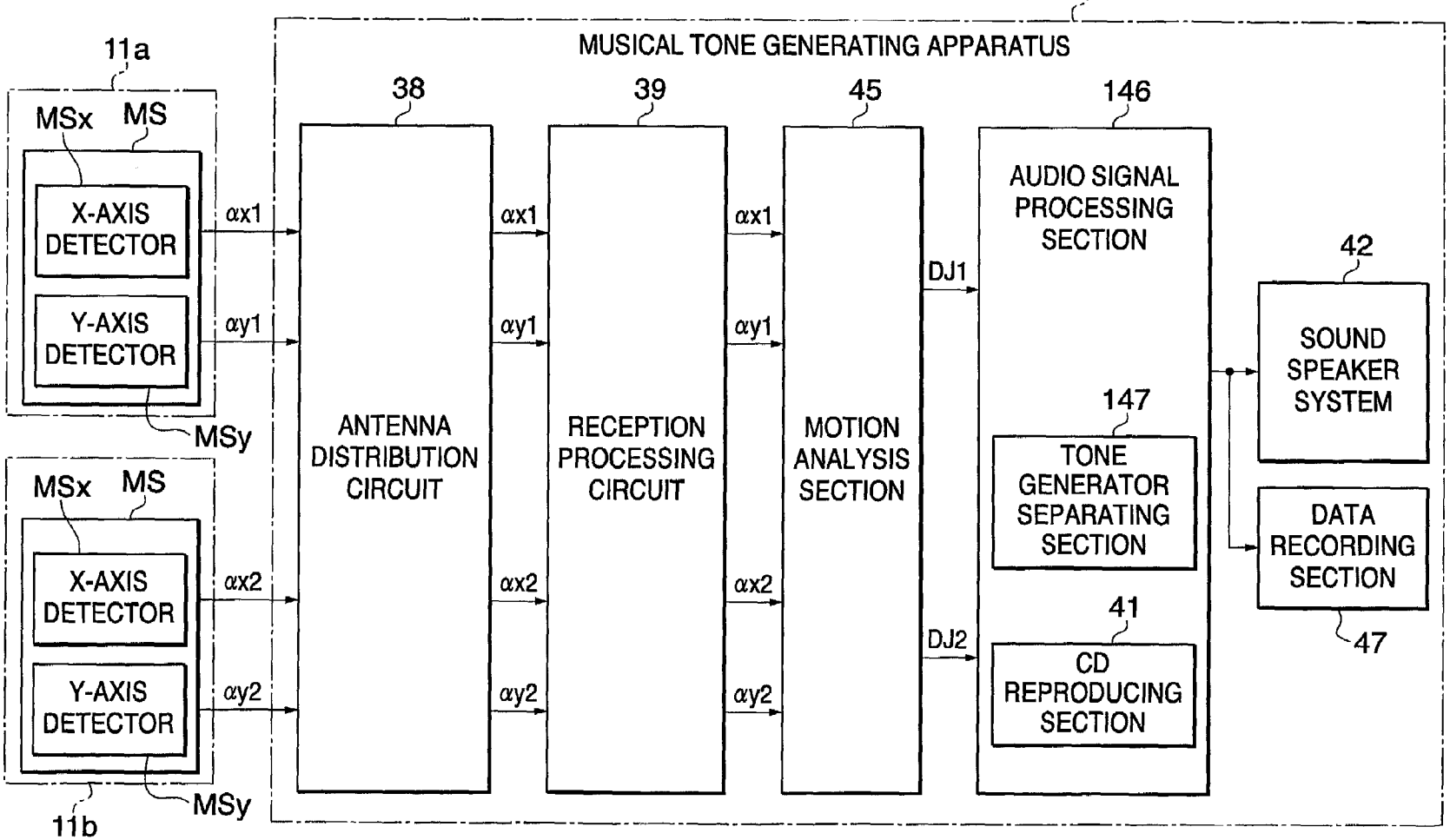
FIG. 8 is a block diagram showing the functional arrangement of a musical tone generating system according to a variation of the embodiment of the present invention.

To control generation of musical tones reproduced from a music CD by using two or more operating terminals 11 as mentioned above, musical tone generating processing may be carried out such that a plurality of tone generator parts (e.g. singing part and musical instrument part) included in an audio signal acquired by reproduction of the music CD are separated, and processing is performed on an audio signal component of each of the tone generator parts according to a motion of the operating terminal 11, which motion is made to correspond to each of the separated tone generator parts in advance. Referring to FIG. 8, a description will now be given of the functional arrangement of a musical tone generating apparatus 10' that carries out such musical tone generating processing.

As shown in FIG. 8, the musical tone generating apparatus 10' that carries out the musical tone generating processing which includes separating tone generator parts as described above is comprised of operating terminals 11*a*, 11*b* constructed in the same manner as the operating terminal 11 of the above described embodiment; the antenna distribution circuit 38, the reception processing circuit 39, the sound speaker system 42, the motion analysis section 45, and the data recording section 47, which are identical with those of the above described embodiment; and an audio signal processing section 146 that is provided in place of the audio signal processing section 46.

Each of the operating terminals 11*a*, 11*b* radio-transmits detected motion signals from the x-axis detector MSx and the y-axis detector MSy according to a motion of the operator, i.e. the acceleration $\alpha x1$, $\alpha x2$ in the direction of the x-axis and the acceleration $\alpha y1$, $\alpha y2$ in the direction of the y-axis. The antenna distribution circuit 38 receives the acceleration $\alpha x1$, $\alpha x2$ in the direction of the x-axis and the acceleration $\alpha y1$, $\alpha y2$ in the direction of the y-axis, which are transmitted from each of the operating terminals 11*a*, 11*b*, and outputs the same to the reception processing circuit 39. The reception processing circuit 39 subjects signals indicative of the detected accelerations in the directions of the x-axis and the y-axis, which are supplied from the antenna distribution circuit 38, to predetermined band path filtering to remove frequency components that are unnecessary for the motion analysis section 45 to detect the motion. The reception processing circuit 39 then outputs the signals representing the acceleration $\alpha x1$, $\alpha x2$ and the accelerations $\alpha y1$, $\alpha y2$ to the motion analysis section 45.

The motion analysis section 45 detects motions of the respective operating terminals 11*a*, 11*b* held by the operator from the accelerations $\alpha x1$, $\alpha x2$ and the accelerations $\alpha y1$, $\alpha y2$ in the directions of the x-axis and the y-axis, which are supplied from the reception processing circuit 39. The motion analysis section 45 outputs motion information DJ1, which is comprised of motion timing information and moving amount information based on the sensor output transmitted from the operating terminal 11*a*, and motion information DJ2, which is comprised of motion timing information and moving amount information based on the sensor output transmitted from the operating terminal 11*b*, to the audio signal processing section 146. It should be noted that the motion timing information and the moving amount information are identical with those of the above described embodiment.

The audio signal processing section 146 has a tone generator separating section 147. The tone generator separating section 147 estimates the basic frequency of each signal in a frequency range of an audio signal reproduced by the CD reproducing section 41 and extracts a harmonic structure from the audio signal to carry out a known tone generator separating process of synthesizing components collected from one tone generator. Thus, the audio signal processing section 146 separates the audio signal into audio signal components (hereinafter called "audio signals") of predetermined plural tone generator parts (e.g. singing part and musical instrument part). In this example, the operating terminal 11*a* is assigned to control of a singing part, and the operating terminal 11*b* is assigned to control of a musical instrument part. The audio signal processing section 146 performs processing on the audio signal of the singing part according to the motion information DJ1 based on the sensor output transmitted from the operating terminal 11*a*. On the other hand, the audio signal processing section 146 performs processing on the audio signal of the musical instrument part according to the motion information DJ2 based on the sensor output transmitted from the operating terminal 11*b*. In this manner, a musical composition recorded on a music CD can be controlled for every tone generator part.

Variation 4

Further, although in the above described embodiment, the operator moves the operating terminal 11 to carry out the time-base compression and expansion of an audio signal reproduced by the CD reproducing section 41 at regular time intervals "t", thereby controlled the tempo of a musical composition being reproduced, there is no intention to limit the invention to this. For example, tone image orientating processing may be carried out such that the position of a virtual tone generator is set for an audio signal reproduced by the CD reproducing section 41 according to a motion of the operating terminal 11 to simulate a case where a tone generator is actually located at the set position.

Figure 9:
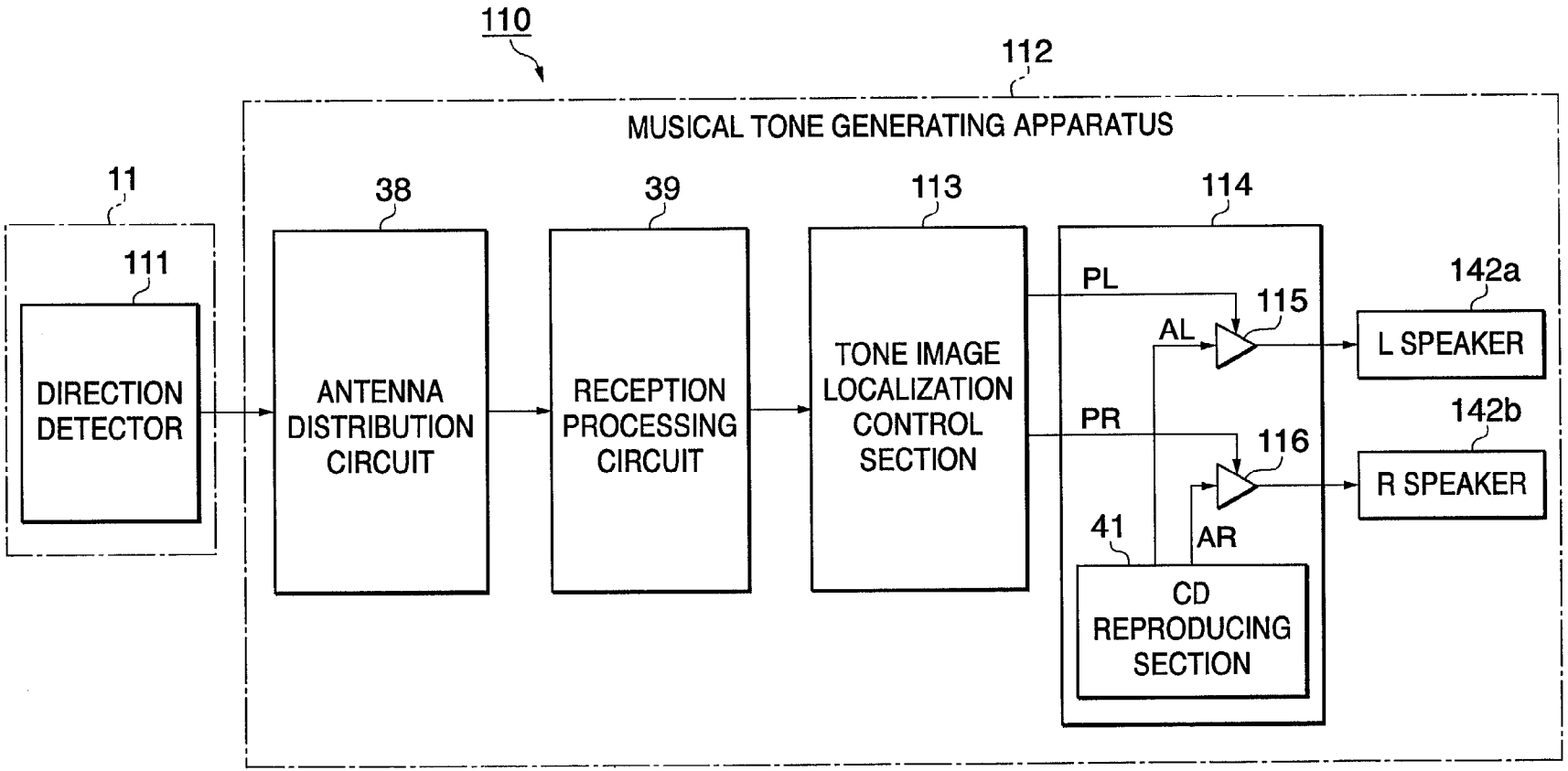
FIG. 9 is a block diagram showing the functional arrangement of a musical tone generating system according to another variation of the embodiment.

For example, in performing 2-channel stereophonic reproduction, musical tone generating processing may be carried out such that a virtual tone generator position is set to a position in a direction indicated by one end of the operating terminal 11 held by the operator, and tone image localization processing is carried out to simulate the case where the tone generator is actually located at the set position. Referring to FIG. 9, a description will now be given of the functional arrangement of a musical tone generating system 110 that carries out such musical tone generating processing.

As shown in FIG. 9, a direction detector 111 is provided in place of the motion sensor MS in the operating terminal 11, and the direction detector 111 detects a direction indicated by one end of the operating terminal 11 operated by the operator. If the direction detector 111 is formed by a gradient sensor, a gyro sensor, or the like, it is capable of detecting a direction in a three-dimensional space. A signal indicative of the direction thus detected by the direction detector 111 is transmitted from the operating terminal 11 to a musical tone generating apparatus 112, where it is supplied to a tone image localization control section 113 via the antenna distribution circuit 38 and the reception processing circuit 39. The tone image localization control section 113 sets a position in a direction indicated by one end of the operating terminal 11 as a virtual tone generator position according to information indicative of the direction indicated by the one end of the operating terminal 11, which is supplied from the reception processing circuit 39, and outputs panning information corresponding to the set position to the audio signal processing section 114. The audio signal processing section 114 performs signal processing in accordance with the panning information.

Specifically, the tone image localization control section 113 acquires panning information PL, PR corresponding to the set position by referring to a table of the relationship between a large number of virtual tone generator positions, which are found by conducting an experiment or the like and stored in advance, and panning information that should be supplied to respective ones of amplitude modulators 115, 116. The tone image localization control section 113 outputs the acquired panning information PL, PR to the respective amplitude modulators 115, 116. The amplitude modulators 115, 116 are each comprised of a digital multiplier or the like, and receive, respectively, a left-channel audio signal AL and a right-channel audio signal AR reproduced by the CD reproducing section 41. The amplitude modulators 115, 116 modulate the amplitudes of the respective audio signals AL, AR according to the panning information PL, PR. The audio signals AL, AR with the amplitudes having been modulated by the amplitude modulators 115, 116 are supplied to a left speaker 142*a* and a right speaker 142*b* to generate musical tones corresponding to the audio signals AL, AR with the modulated amplitudes via the left speaker 142*a* and the right speaker 142*b*, respectively. In this manner, the tone image localization may be carried out on the audio signal acquired by reproduction of a music CD according to the position indicated by the operating terminal 11 operated by the operator.

Further, not only the above-mentioned audio signals of two channels acquired by reproduction of a music CD but also audio signals of about five channels, which are called multichannel audio signals, may be inputted. For example, multichannel audio signals of six channels in total such as a front left channel, a front right channel, a center channel, a rear left channel, a rear right channel, and a low-pass only channel, i.e. audio signals called 5.1-channel audio signals may be inputted as audio signals reproduced from a DVD (Digital Versatile Disc). The low-pass only channel is a channel through which audio signals with a lower frequency range than about 120 Hz are only acquired. Audio signals acquired through this channel are supplied to a speaker that generates only low-frequency tones so that low-frequency musical tones can be generated by the speaker. Audio signals through channels other than the low-frequency only channel are supplied to speakers provided for respective ones of those channels, so that musical tones can be generated by respective ones of the speakers. As is the case with the above described stereophonic reproduction, the system that generates musical tones according to multi-channel audio signals may carry out amplitude modulation, phase adjustment, frequency characteristic adjustment, etc. of audio signals of respective channels to control the tone image localization.

Variation 5

Figure 10A:
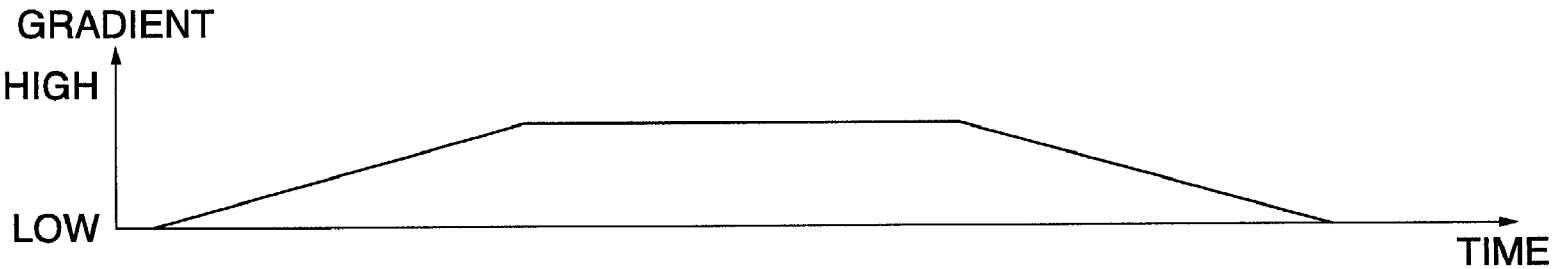
Figure 10B:
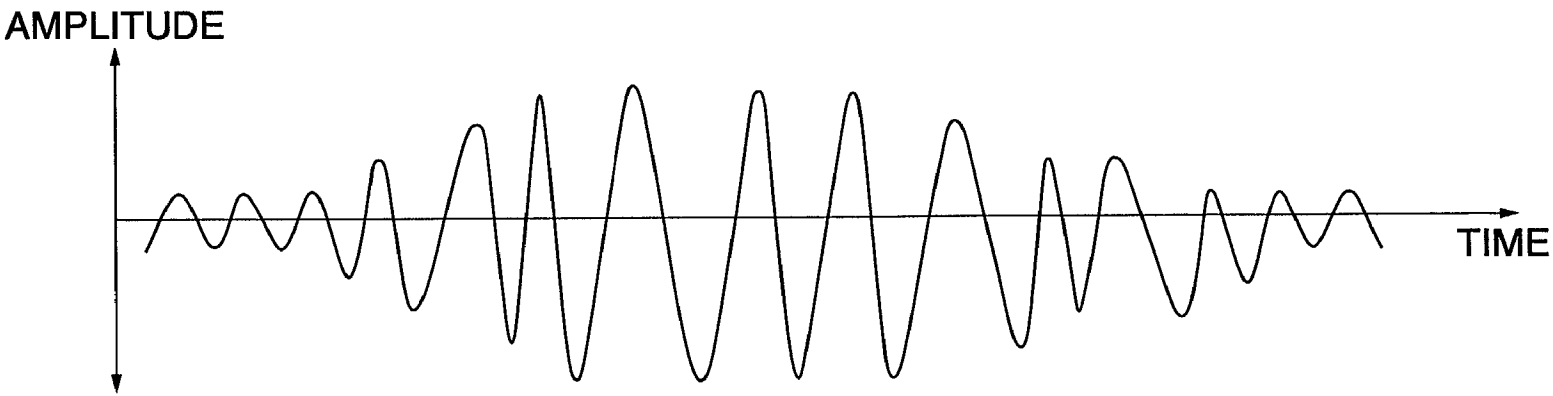

Further, a gradient sensor may be used as the motion sensor MS in the operating terminal 11, and the amplitude adjustment, the frequency characteristic adjustment, etc. may be carried out on an audio signal outputted from the CD reproducing section 41 by reproduction of a music CD, according to the gradient of the operating terminal 11 held by the operator. For example, if an output signal as shown in FIG. 10A is outputted from the gradient sensor provided in the operating terminal 11, the amplitude adjustment is carried out such that the amplitude of an audio signal reproduced by the CD reproducing section 41 is increased with an increase in the gradient detected by the gradient sensor, so that an audio signal as shown in FIG. 10B is outputted to the sound speaker system 41 to generate musical tones.

Variation 6

Figure 11:
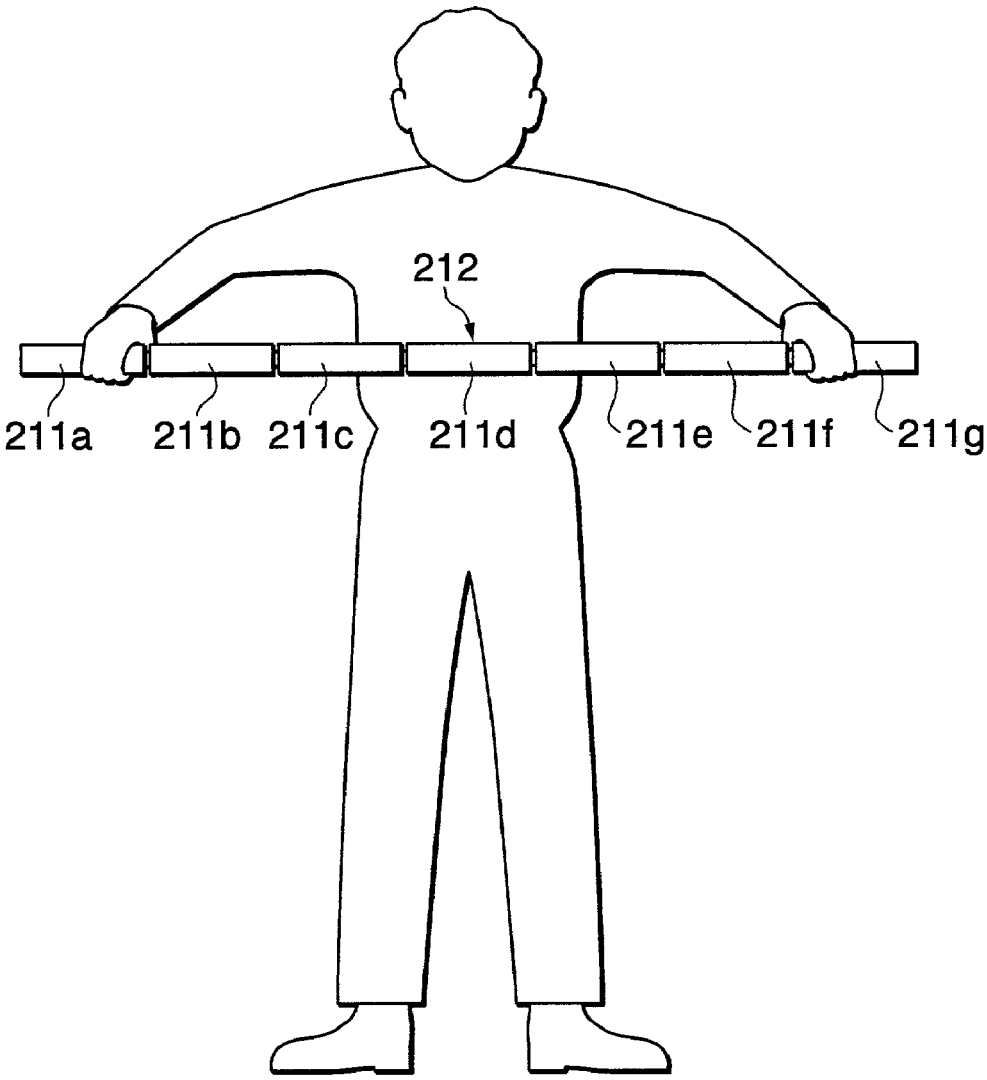
FIG. 11 is a view showing the appearance of a variation of the operating terminal.

Further, operating terminals having a variety of shapes, such as a band-type operating terminal and a shoe-shaped operating terminal, may be used in place of the rod-shaped operating terminal 11 in FIG. 1. For example, as shown in FIG. 11, an operating terminal 212 comprised of multiple (seven in the illustrated example) rod-shaped operating members 211*a*, 211*b*, 211*c*, 211*d*, 211*e*, 211*f*, and 211*g* may be used to perform processing on an audio signal reproduced by the CD reproducing section 41 according to a motion of the operating terminal 212 to control generated musical tones.

Figure 12:
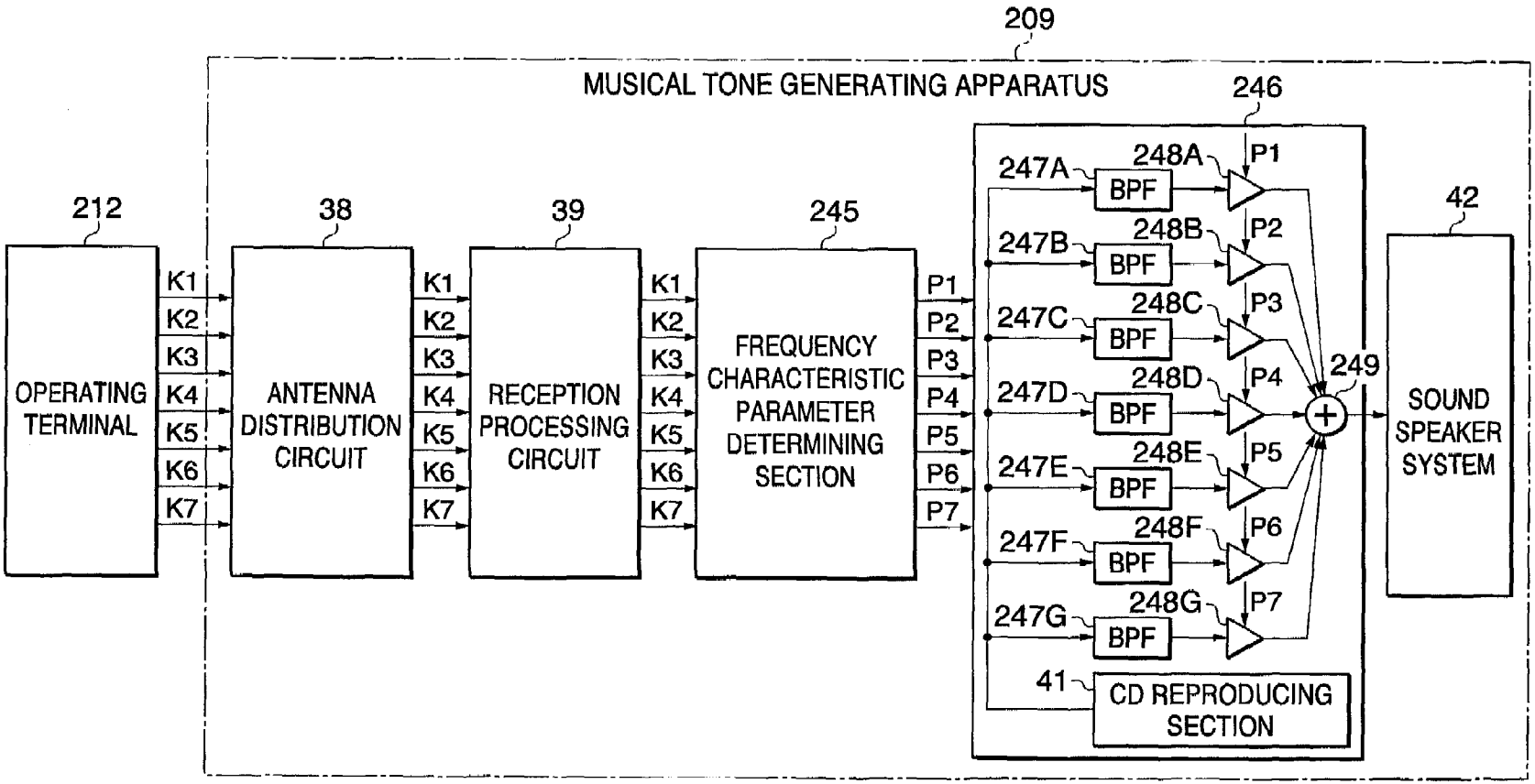
FIG. 12 is a block diagram showing an example of the functional arrangement of a musical tone generating system that generates musical tones according to the operation of the operating terminal shown in FIG. 11.

The rod-shaped operating members 211*a*, 211*b*, 211*c*, 211*d*, 211*e*, 211*f*, and 211*g* are arranged such that ends of the adjacent rod-shaped members are connected to each other in such a manner that relative positions of the rod-shaped members are variable. Each of the rod-shaped operating members 211*a*, 211*b*, 211*c*, 211*d*, 211*e*, 211*f*, 211*g* includes a gradient sensor. The operating terminal 212 gives IDs for identification of the respective rod-shaped members to signals outputted from the gradient sensors included in the respective rod-shaped operating members 211*a*, 211*b*, 211*c*, 211*d*, 211*e*, 211*f*, 211*g*, and transmits the signals with the IDs. Referring to FIG. 12, a description will now be given of a musical tone generating system that controls generation of musical tones according to the output signals transmitted from the operating terminal 212 with the gradient sensors installed therein.

Figure 13A:
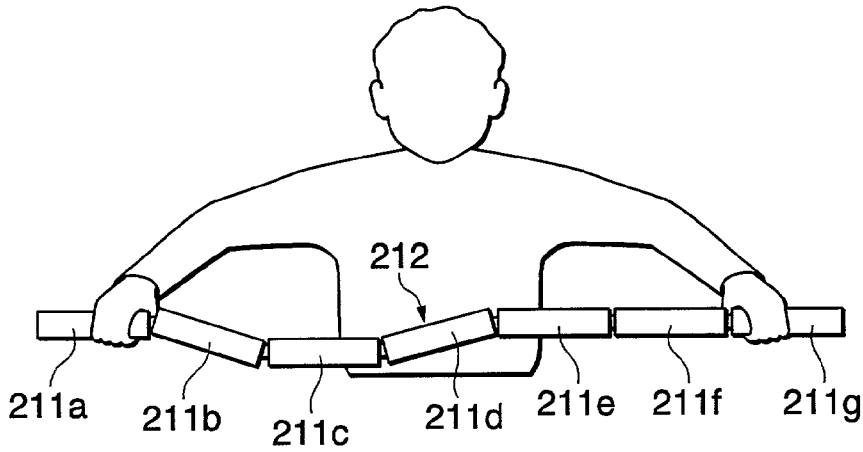
Figure 13B:
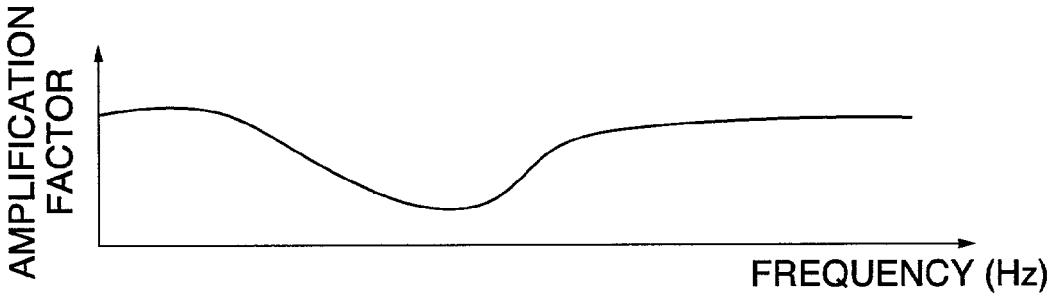

As shown in FIG. 12, the operating terminal 212 transmits output signals K1, K2, K3, K4, K5 K6, and K7 from the gradient sensors included in the rod-shaped operating members 211*a*, 211*b*, 211*c*, 211*d*, 211*e*, 211*f*, and 211*g* to a musical tone generating apparatus 209. The output signals are supplied to a frequency characteristic parameter-determining section 245 via the antenna distribution circuit 38 and the reception processing circuit 39. The frequency characteristic parameter-determining section 245 determines parameters P1, P2, P3, P4, P5, P6, and P7 representing the amplitude modulation ratio of seven frequency bands corresponding to the respective rod-shaped operating members 211*a*, 211*b*, 211*c*, 211*d*, 211*e*, 211*f*, and 211*g* based on the output signals K1, K2, K3, K4, K5 K6, and K7 corresponding to the gradient of the respective rod-shaped operating members 211*a*, 211*b*, 211*c*, 211*d*, 211*e*, 211*f*, and 211*g*, which are supplied from the reception processing circuit 39. The frequency characteristic parameter-determining section 245 then outputs the determined parameters P1, P2, P3, P4, P5, P6, and P7 to the audio signal processing section 246. The frequency characteristic parameter determining section 245 may determine the parameters such that the amplitude is increased with an increase in the gradient of the respective rod-shaped operating members 211*a*, 211*b*, 211*c*, 211*d*, 211*e*, 211*f*, and 211*g*, or may determine the parameters such that a frequency characteristic (FIG. 13B) is obtained, which is analogous to the shape presented by the seven rod-shaped operating members 211*a*, 211*b*, 211*c*, 211*d*, 211*e*, 211*f*, and 211*g* (refer to FIG. 13A).

The audio signal processing section 246 has band pass filters 247A, 247B, 247C, 247D, 247E, 247F, and 247G, through which signals in the seven frequency bands are passed. Audio signals reproduced by the CD reproducing section 41 are supplied to respective corresponding ones of the band pass filters 247A, 247B, 247C, 247D, 247E, 247F, and 247G. Each of the band pass filters 247A, 247B, 247C, 247D, 247E, 247F, and 247G outputs only an audio signal in the corresponding frequency band to a corresponding one of amplitude modulators 248A, 248B, 248C, 248D, 248E, 248F, and 248G. The above-mentioned parameters P1, P2, P3, P4, P5, P6, and P7 are supplied to the respective amplitude modulators 248A, 248B, 248C, 248D, 248E, 248F, and 248G. The amplitude modulators 248A, 248B, 248C, 248D, 248E, 248F, and 248G adjust the amplitude of the respective audio signals according to the supplied parameters, and outputs the audio signals with the adjusted amplitude to an adder 249. The adder 249 adds up the audio signals with the adjusted amplitude supplied from the amplitude modulators 248A, 248B, 248C, 248D, 248E, 248F, and 248G, and outputs the result to the sound speaker system 42. Consequently, musical tones are generated with the frequency characteristics, i.e. the tone color adjusted according to the gradient of the rod-shaped operating members 211*a*, 211*b*, 211*c*, 211*d*, 211*e*, 211*f*, and 211*g* of the operating terminal 212.

Variation 7

Figure 14:
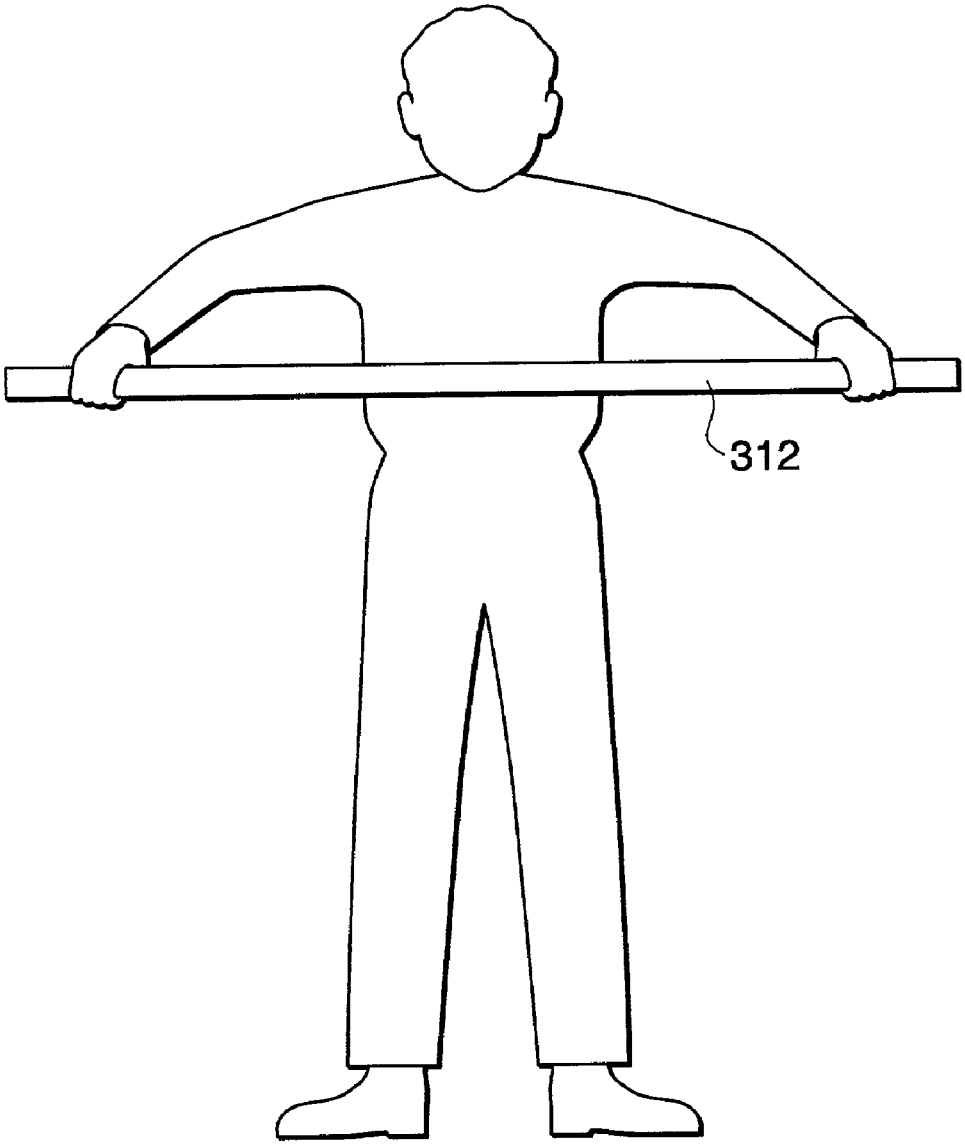
FIG. 14 is a view showing the appearance of another variation of the operating terminal.

Further, in place of the short rod-shaped operating terminal 11 in FIG. 1, a long rod-shaped operating terminal 312 as shown in FIG. 14 may be used to perform processing on an audio signal reproduced by the CD reproducing section 41 according to a motion of the operating terminal 312 to control musical tones being generated.

Figure 15:
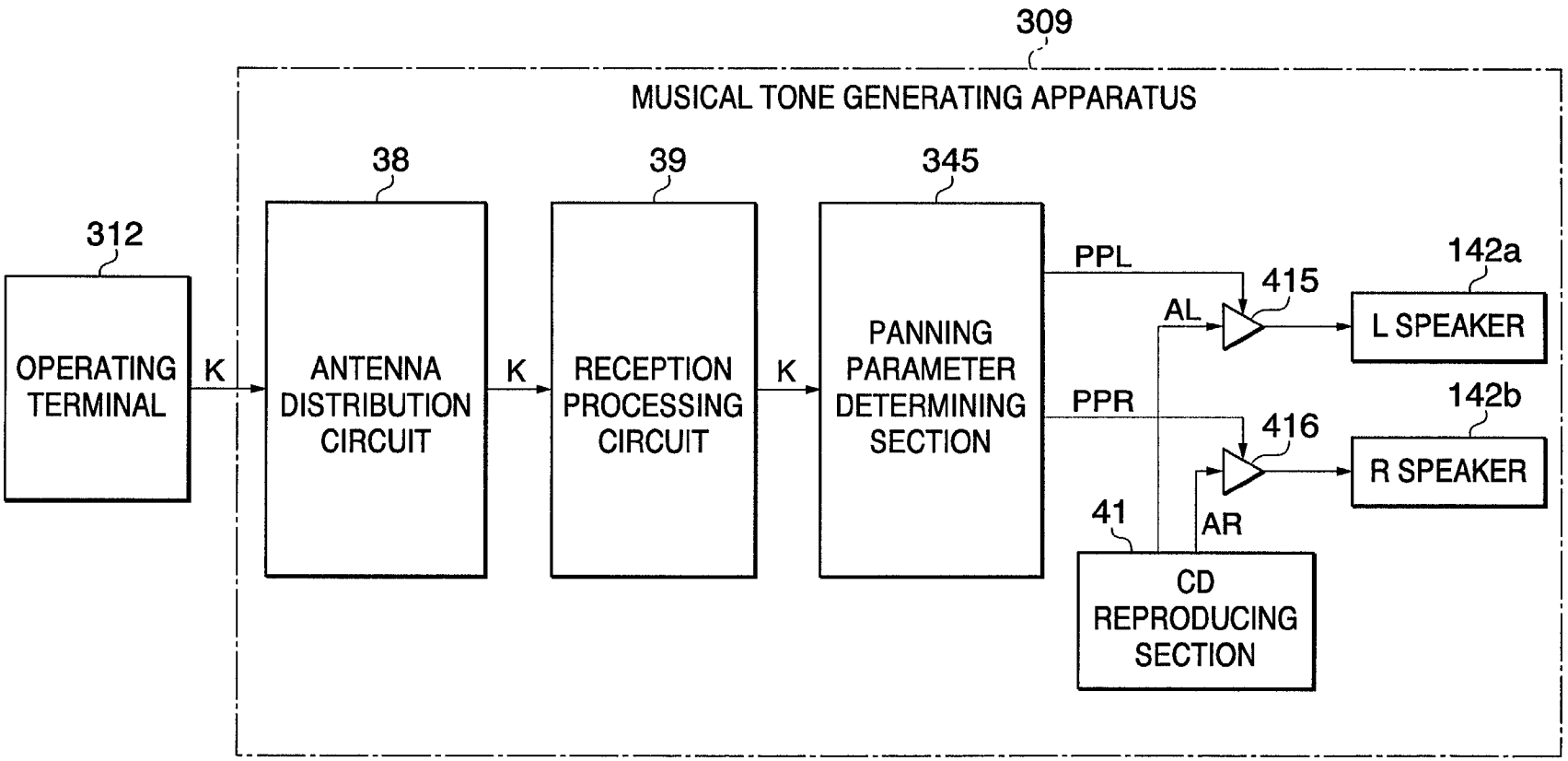
FIG. 15 is a block diagram showing an example of the functional arrangement of a musical tone generating system that generates musical tones by means of the operating terminal shown in FIG. 11.

The operating terminal 312 has a gradient sensor incorporated therein, and transmits a sensor output signal from the gradient sensor. Referring to FIG. 15, a description will be given of a musical tone generating system that controls generation of musical tones according to a sensor output signal transmitted from the operating terminal 312.

Figure 16:
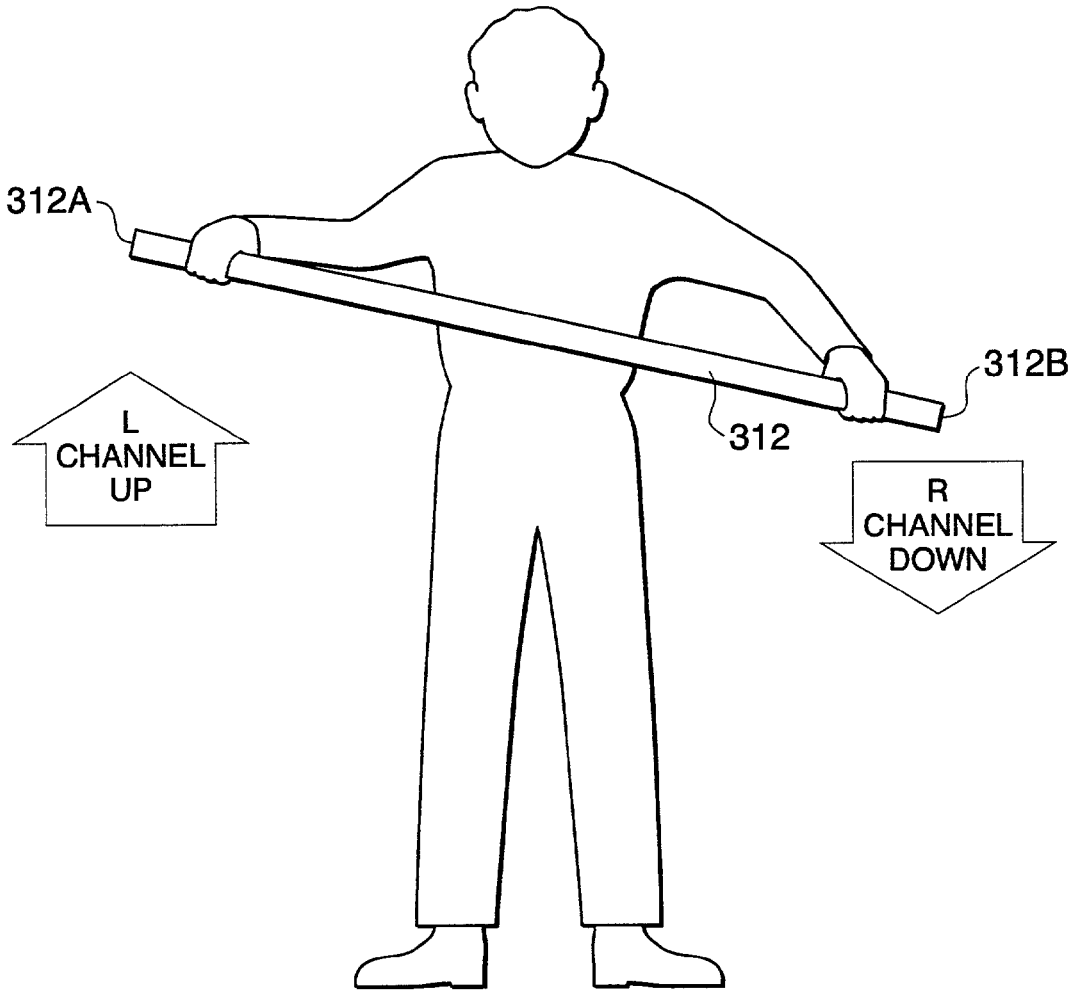
FIG. 16 is a diagram useful in explaining the relationship between the condition of the operating terminal shown in FIG. 11 and signal processing performed according to the condition.

As shown in FIG. 15, the operating terminal 312 radio-transmits the sensor output signal to a musical tone generating apparatus 309. The sensor output signal is supplied to a panning parameter determining section 345 via the antenna distribution circuit 38 and the reception processing circuit 39. The panning parameter determining section 345 determines parameters PPL and PPR representing the amplitude modulation ratio of audio signals of left and right channels based on an output signal K corresponding to the gradient of the operating terminal 312, which is supplied from the reception processing circuit 39. The panning parameter determining section 345 then outputs the determined parameters PPL, PPR to amplitude modulators 415, 416, respectively. For example, as shown in FIG. 16, the frequency characteristic parameter determining section 345 determines the parameters PPL, PPR according to the gradient of the operating terminal 312 such that a larger gain is set for the left channel that is made to correspond to an upper end 312A of the operating terminal 312 in advance, and a smaller gain is set for the right channel that is made to correspond to a lower end 312B of the operating terminal 312 in advance.

As described above, the frequency characteristic parameter determining section 345 outputs the determined parameters PPL, PPR to the amplitude modulators 415, 416, respectively. The amplitude modulators 415, 416 are each comprised of a digital multiplier or the like, and receive, respectively, a left-channel audio signal AL and a right-channel audio signal AR reproduced by the CD reproducing section 41. The amplitude modulators 415, 416 carry out amplification or the like of the audio signals AL, AR according to the parameters PPL, PPR. The audio signals AL, AR with the amplitudes thus modulated through amplification or the like by the amplitude modulators 415, 416 are supplied to a left speaker 142*a* and a right speaker 142*b*, respectively. Musical tones corresponding to the audio signals AL, AR with the modulated amplitudes are generated via the left speaker 142*a* and the right speaker 142*b*.

Variation 8

Further, although in the above described embodiment and variations, signal processing is performed on audio signals acquired by reproduction of a music CD according to a motion of the operating terminal 11, there is no intention to limit the invention to this. For example, an entertainment system may be constructed as follows: Predetermined motions of the operating terminal and pitches are made to correspond to each other in advance. When a certain musical composition recorded on a music CD is reproduced, it is determined whether or not pitches specified by a sequence of motions of the operating terminal operated by the operator coincide with a pitch sequence constituting the musical composition, and the operator is notified of the determination result.

Figure 17:
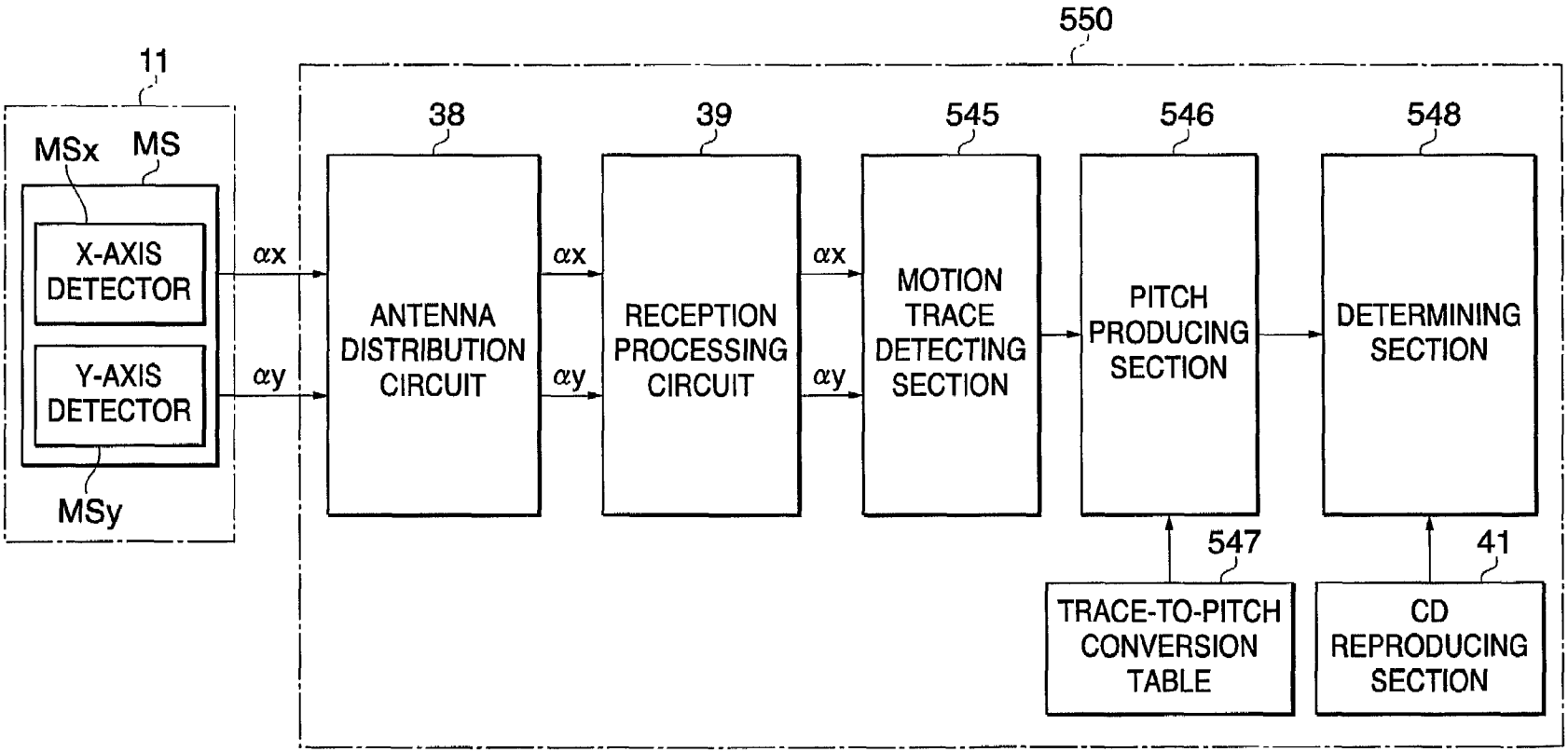
FIG. 17 is a block diagram showing the functional arrangement of the musical tone generating system according to still another variation of the embodiment.

FIG. 17 shows the functional arrangement of such an entertainment system. As shown in FIG. 17, this entertainment system is comprised of the operating terminal 11 identical with the one of the above described embodiment, and a determination device 550 that includes the antenna distribution circuit 38, reception processing circuit 39, motion trace detecting section 545, pitch producing section (musical contents information producing means) 546, trace-to-pitch conversion table 547, and determining section 548.

As is the case with the above described embodiment, the operating terminal 11 transmits information indicative of the acceleration $\alpha x$ in the direction of the x-axis and the acceleration $\alpha y$ in the direction of the y-axis. The antenna distribution circuit 38 of the determination device 550 receives the transmitted information, and outputs signals indicative of the acceleration $\alpha x$ in the direction of the x-axis and the acceleration $\alpha y$ in the direction of the y-axis to the motion trace detecting section 545 via the reception processing circuit 39.

The motion trace detecting section 545 detects a trace of motion of the operating terminal 11 from the acceleration $\alpha x$ in the direction of the x-axis and the acceleration $\alpha y$ in the direction of the y-axis, which are supplied from the reception processing circuit 39. In this case, the motion trace detecting section 545 determines that the operating terminal 11 has started moving, at a time point when the acceleration $\alpha x$ or $\alpha y$ becomes greater than a predetermined fine value after the accelerations $\alpha x$ and $\alpha y$ are smaller than the predetermined fine value (i.e. when the operating terminal 11 hardly moves). The motion trace detecting section 545 starts detecting the trace of motion of the operating terminal 11 from this time point. On the other hand, during the detection of the trace, if the acceleration $\alpha x$ or $\alpha y$ becomes smaller than the predetermined value (i.e. when the operating terminal 11 becomes substantially motionless), the motion trace detecting section 545 ceases detecting the trace of motion of the operating terminal 11. In this manner, the motion trace detecting section 545 can detect a trace of sequential motions of the operating terminal 11 operated by the operator. Although a period of time for detection of the trace of motion is determined according to the values $\alpha x$ and $\alpha y$ in the above described manner, the operating terminal 11 may be provided with a switch or the like that specifies the period of time for detection of the trace of motion so that the trace detecting section 545 can detect one trace of motion of the operating terminal 11 according to the values $\alpha x$ and $\alpha y$ during depression of the switch. In this case, the operator moves the operating terminal 11 as he or she desires while depressing the switch only during the period of time required for detection of the trace of motion.

The trace detecting section 545 acquires information on the trace of motion the operating terminal 11 from the accelerations $\alpha x$ and $\alpha y$ supplied from the reception processing circuit 39 during the above-mentioned period of time. The information on the trace of motion is shape information indicative of a shape described by the trace of motion of the operating terminal 11. The trace of motion of the operating terminal 11 describes a circle, oval, square, triangle, figure eight, and so forth. The trace-to-pitch conversion table 547 contains pitch information corresponding to such various shapes of the trace of motion. With reference to the trace-to-pitch conversion table 547, the pitch producing section 546 specifies a pitch that corresponds to the shape of the trace of motion of the operating terminal 11 moved by the operator. The pitch producing section 546 carries out such pitch specifying processing every time it receives shape information from the motion trace detecting section 545, and sequentially outputs the specified pitches to the determining section 548.

On the other hand, the determining section 548 is supplied with CD pitch sequence information constituting a musical composition recorded on a music CD that is reproduced by the CD reproducing section 41. The determining section 548 compares the CD pitch sequence information with a pitch sequence of the pitches supplied from the pitch producing section 546. The determining section 548 determines whether they coincide with each other or not, and notifies the operator of the degree of coincidence. It should be noted that the CD pitch sequence information constituting a musical composition recorded on a music CD that is reproduced by the CD reproducing section 41 may be acquired by detecting a pitch of reproduced audio signals (whose tone generator may be divided into musical instrument parts and vocal parts), or may be acquired by storing in advance pitch sequence information on respective ones of many musical compositions.

Further, although in the above described variation, the pitch producing section 546 produces pitch information according to the motion trace notified by the trace detecting section 545, but it may produce beat information according to the motion track. In this case, the determining section 548 may acquire beat information on a musical composition being reproduced by the CD reproducing section 41, compare the acquired beat information with beat information produced according to a motion trace of the operating terminal, and notify the operator of the degree of coincidence. Further, the pitch producing section 546 may produce both pitch information and beat information according to motion information indicative of a trace of motion of the operating terminal 11 or the like, and compare them with pitch sequence information and beat information on a musical composition being reproduced by the CD reproducing section 41.

Variation 9

Although in the above described embodiment, the signal processing is performed on the audio signals reproduced by the CD reproducing section 41 according to a motion of the operating terminal 11 operated by the operator (e.g. time-base compression and expansion), there is no intention to limit the invention to this. For example, an audio signal for generating a single tone such as a shout, handclap, and percussion tone may be mixed with audio signals reproduced by the CD reproducing section 41 in timing in which the operator widely moves the operating terminal 11. Further, effects such as a reverberation may be applied to audio signals reproduced by the CD reproducing section 41 while the operating terminal 11 is being widely moved.

Variation 10

Although in the above described embodiment and variations, a music CD on which audio data obtained by digitalizing audio signals in the CD-DA format is used as the tone generator source, there is no intention to limit the invention to this. For example, audio data coded from an audio signal in another format, such as the ATRAC (Adaptive Transform Acoustic Coding) format, the MP3 format, or the TwinVQ (Transform-Domain Weighted Interleave Vector Quantization), may be used as the tone generator source. Further, the present invention may be applied to data accompanied by images such as the MPEG (Moving Picture Experts Group-n) format, AVI (audio video interleaved) format, and QuickTime format. In this case, the image signal is synchronized with the audio signal by thinning the image data or repeatedly displaying the image in accordance with the reproduction of the audio data.

Variation 11

Although in the above described embodiment, the output from the motion sensor MS installed in the operating terminal 11 is radio-transmitted to the musical tone generating apparatus 10, there is no intention to limit the invention to this. For example, the operating terminal 11 and the musical tone generating apparatus 10 may be connected to each other via a signal cable or the like, so that an output from the motion sensor MS can be transmitted from the operating terminal 11 to the musical tone generating apparatus 10 via the signal cable. Further, in the above described variations, the output from the motion sensor MS should not necessarily be radio-transmitted, but may be transmitted by wire.

Further, although in the above described embodiment, the operating terminal 11 and the musical tone generating apparatus 10 are configured in separate bodies, this is not limitative, but they may be configured as an integral unit. Further, in the above described variations, the operating terminal 11 and the musical tone generating apparatus 10 may be configured as an integral unit.

Variation 12

Further, although in the above described embodiment, the program for implementing processing for determining the kind of signal processing (e.g. determination of the compression and expansion ratios of the time-base compression and expansion, and determination fo the amplification factor) to be performed on the audio signal reproduced by the CD reproducing section 41 according to the motion information supplied from the operating terminal 11, is preinstalled in the hard disk drive 33 of the CPU 30 or the like, there is no intention to limit the invention to this. For example, the program may be installed by reading a recording medium comprised of a package medium such as a CD-ROM (CD-Recordable) and a DVD-ROM (DVD-Read Only Memory) in which the program is recorded, to cause a computer system comprised of a CPU and others to execute the program. The program may be also installed by reading a recording medium such as a semiconductor memory and a magneto-optical disk in which the program is stored temporarily or permanently. The program may be installed by downloading into the musical tone generating apparatus 10 through a transmission medium such as the Internet.

What is claimed is:

1. An audio signal generating apparatus comprising:

a motion information acquiring device that acquires motion information corresponding to a motion of a user;

a storage device that stores audio data coded from an audio signal comprising a musical composition according to a predetermined format and tempo marks corresponding to the tempo of the musical composition at regular time intervals in a period of time in which the audio data are to be reproduced;

a reading-out device that reads out the audio data and tempo marks from said storage device at a predetermined readout speed;

an audio signal acquiring device that acquires waveform data corresponding to the audio signal from the audio data read out from said storage device by said reading-out device; and a signal processing device that performs processing on the waveform data acquired by said audio signal acquiring device based on the tempo marks read out from said storage device by said reading-out device, and the motion information acquired by said motion information acquiring device.

2. An audio signal generating apparatus according to claim 1, further comprising a recording device that records the waveform data having been processed by said signal processing device according to the motion information.

3. An audio signal generating apparatus according to claim 1, wherein said motion information acquiring device receives motion information transmitted from at least one operating terminal capable of being carried by an operator, said operating terminal generating the motion information corresponding to a motion of the operator carrying the operating terminal, and said signal processing device performs processing on the waveform data acquired by said audio signal acquiring device according to the motion information received by said motion information acquiring device.

4. An audio signal generating apparatus according to claim 1, wherein said signal processing device performs processing for controlling at least one selected from the group consisting of tempo, volume, timing, tone color, and effect on the waveform data acquired by said audio signal acquiring device according to the motion information.

5. An audio signal generating apparatus according to claim 1, wherein said signal processing device performs time-base compression and expansion of the waveform data acquired by said audio signal acquiring device so as to convert the audio signal into an audio signal with a tempo corresponding to the motion information.

6. An audio signal generating apparatus according to claim 1, wherein said signal processing device performs tone image localization of the waveform data acquired by said audio signal acquiring device.

7. An audio signal generating apparatus according to claim 1, wherein said signal processing device carries out amplitude adjustment of the waveform data acquired by said audio signal acquiring device in every predetermined frequency band.

8. An audio signal generating apparatus according to claim 1, further comprising a determination device that determines an offset amount from an original tempo of the waveform data acquired by said audio signal acquiring device according to the motion information, and wherein said signal processing device changes the original tempo of the acquired audio signal by the determined offset amount.

9. An audio signal generating apparatus according to claim 1, wherein said motion information acquiring device comprises a plurality of motion information acquiring devices, and said signal processing device performs processing for controlling different objects according to the motion information acquired by respective ones of said motion information acquiring devices, on the waveform data acquired by said audio signal acquiring device.

10. An audio signal generating system comprising:

at least one operating terminal capable of being carried by an operator, said operating terminal generating motion information corresponding to a motion of the operator carrying said operating terminal and transmitting the generated motion information; and an audio signal generating device that generates an audio signal comprising a musical composition from audio data coded from the audio signal according to a predetermined format; and wherein said audio signal generating device comprises a receiving device that receives the motion information transmitted from said operating terminal, a storage device that stores the audio data and tempo marks corresponding to the tempo of the musical composition at regular time intervals in a period of time in which the audio data are to be reproduced, a reading-out device that reads out the audio data and tempo marks from said storage device at a predetermined readout speed, an audio signal acquiring device that acquires waveform data corresponding to the audio signal from the audio data read out from said storage device by said reading-out device, and a signal processing device that performs processing on the waveform data acquired by said audio signal acquiring device based on the tempo marks read out from said storage device by said reading-out device, and the motion information received by said receiving device.

11. An audio system comprising:

at least one operating terminal capable of being carried by an operator, said operating terminal generating motion information corresponding to a motion of the operator carrying said operating terminal and transmitting the generated motion information;

a receiving device that receives the motion information transmitted from said operating terminal;

a storage device that stores audio data coded from an audio signal comprising a musical composition according to a predetermined format and tempo marks corresponding to the tempo of the musical composition at regular time intervals in a period of time in which the audio data are to be reproduced;

a reading-out device that reads out the audio data and tempo marks from said storage device at a predetermined readout speed;

a reproducing device that reproduces waveform data corresponding to the audio signal from the audio data read out from said storage device by said reading-out device;

a musical contents acquiring device that acquires first musical contents information including at least one of a pitch sequence and beats constituting the musical composition in the waveform data being reproduced by said reproducing device;

a musical contents information producing device that produces second musical contents information including at least one of pitch information and beat information based on the tempo marks read out from said storage device by said reading-out device, and the motion information received by said receiving device when the waveform data is being reproduced by said reproducing device; and a determination device that compares the first musical contents information and the second musical contents information and outputs results of the comparison.

12. An audio signal generating method comprising the steps of:

acquiring motion information corresponding to a motion of a user;

storing to a storage device, audio data coded from an audio signal comprising a musical composition according to a predetermined format and tempo marks corresponding to the tempo of the musical composition at regular time intervals in a period of time in which the audio data are to be reproduced;

reading out the audio data and tempo marks from said storage device at a predetermined readout speed;

acquiring waveform data corresponding to the audio signal from the audio data read out from said storage device; and performing processing on the acquired waveform data based on the tempo marks read out from said storage device, and the acquired motion information.

13. A program embodied on a computer-readable medium that causes a computer to execute an audio signal generating method comprising the steps of:

acquiring motion information corresponding to a motion of a user;

storing to a storage device, audio data coded from an audio signal comprising a musical composition according to a predetermined format and tempo marks corresponding to the tempo of the musical composition at regular time intervals in a period of time in which the audio data are to be reproduced;

reading out the audio data and tempo marks from said storage device at a predetermined readout speed;

acquiring waveform data corresponding to the audio signal from the audio data read out from said storage device; and performing processing on the acquired waveform data based on the tempo marks read out from said storage device, and the acquired motion information.

14. A machine readable storage medium containing a group of instructions for causing a machine to execute an audio signal generating method comprising the steps of:

acquiring motion information corresponding to a motion of a user;

storing to a storage device, audio data coded from an audio signal comprising a musical composition according to a predetermined format and tempo marks corresponding to the tempo of the musical composition at regular time intervals in a period of time in which the audio data are to be reproduced;

reading out the audio data and tempo marks from said storage device at a predetermined readout speed;

acquiring waveform data corresponding to the audio signal from the audio data read out from said storage device; and performing processing on the acquired waveform data signal based on the tempo marks read out from said storage device, and the acquired motion information.

15. An audio signal generating apparatus according to claim 9, further comprising a tone generator separating device that separates the waveform data acquired by said audio signal acquiring device into waveform data components of plural tone generator parts, wherein said signal processing device performs processing for controlling different objects according to the motion information acquired by respective ones of said motion information acquiring devices, on respective ones of the waveform data components separated by said tone generator separating device.

* * * * *